US011623133B2

(12) United States Patent
Irwin, Jr. et al.

(10) Patent No.: US 11,623,133 B2
(45) Date of Patent: Apr. 11, 2023

(54) APPLYING IMAGING SPECIALTY INKS TO SCRATCH-OFF DOCUMENTS

(71) Applicant: Hydragraphix LLC, Providence, RI (US)

(72) Inventors: Kenneth Earl Irwin, Jr., Dawsonville, GA (US); Keith Cash, Lakeland, FL (US); George Adkins, Plant City, FL (US)

(73) Assignee: Hydragraphix LLC, Providence, RI (US)

( * ) Notice: Subject to any disclaimer, the term of this patent is extended or adjusted under 35 U.S.C. 154(b) by 0 days.

(21) Appl. No.: 17/369,051

(22) Filed: Jul. 7, 2021

(65) Prior Publication Data

US 2022/0016515 A1 Jan. 20, 2022

Related U.S. Application Data

(60) Provisional application No. 63/052,097, filed on Jul. 15, 2020.

(51) Int. Cl.
*A63F 3/06* (2006.01)
*B42D 25/27* (2014.01)
(Continued)

(52) U.S. Cl.
CPC ..... *A63F 3/0655* (2013.01); *A63F 3/065* (2013.01); *A63F 3/0665* (2013.01); *B41M 1/04* (2013.01);
(Continued)

(58) Field of Classification Search
CPC ..... A63F 3/065; A63F 3/0665; A63F 3/0655; A63F 2003/066
See application file for complete search history.

(56) References Cited

U.S. PATENT DOCUMENTS 5,532,046 A * 7/1996 Rich ..... A63F 3/0665 428/209
7,455,323 B2 * 11/2008 Taylor ..... G09B 19/00 283/903
(Continued)

FOREIGN PATENT DOCUMENTS

| | | | |
|---|---|---|---|
| EP | 1228895 | A2 | 8/2002 |
| GB | 2148795 | A | 6/1985 |
| WO | 2019083880 | A1 | 5/2019 |

OTHER PUBLICATIONS

"Domino Launches K600i Label Embellishment Solution", NAPCO Media; https://www.packagingimpressions.com/article/domino-launches-k600i-label-embellishment-solution (8 pages), Jul. 1, 2020.
(Continued)

*Primary Examiner* — Kyle R Grabowski
(74) *Attorney, Agent, or Firm* — Neal, Gerber & Eisenberg LLP

(57) ABSTRACT

A security-enhanced document including a substrate, at least one lower portion of graphic imaging with or without first variable indicia directly or indirectly digitally imaged on the substrate, at least one release coat applied over the lower portion, at least one scratch-off layer over the release coat to maintain the lower portion imaging unreadable until removal of the scratch-off layer, and at least one second surface material portion.

6 Claims, 15 Drawing Sheets

(51) Int. Cl.
*B41M 3/14* (2006.01)
*B41M 1/04* (2006.01)

(52) U.S. Cl.
CPC ..... *B41M 3/14* (2013.01); *A63F 2003/066* (2013.01); *A63F 2003/0675* (2013.01)

(56) References Cited

U.S. PATENT DOCUMENTS

| | | | | |
|---|---|---|---|---|
| 7,712,741 | B2 | 5/2010 | Lambert | |
| 7,837,117 | B2 | 11/2010 | Irwin et al. | |
| 7,883,092 | B2 * | 2/2011 | Stephens | A63F 3/0665 273/292 |
| 8,177,136 | B2 | 5/2012 | Irwin et al. | |
| 9,487,027 | B1 | 11/2016 | Strater et al. | |
| 10,130,869 | B2 | 11/2018 | Finnerty et al. | |
| 10,183,213 | B2 | 1/2019 | Irwin et al. | |
| 10,516,800 | B2 | 12/2019 | Finnerty | |
| 10,742,848 | B2 | 8/2020 | Weil et al. | |
| 2004/0140616 | A1 | 7/2004 | Davis | |
| 2004/0150220 | A1 | 8/2004 | Holmes et al. | |
| 2006/0006639 | A1 * | 1/2006 | Taylor | G09B 19/00 283/49 |
| 2008/0197621 | A1 * | 8/2008 | Grotkowski | A63F 3/065 283/94 |
| 2008/0252066 | A1 | 10/2008 | Rapoport et al. | |
| 2012/0145024 | A1 * | 6/2012 | Scrymgeour | A63F 3/0655 101/483 |
| 2012/0267888 | A1 * | 10/2012 | Behm | A63F 3/0665 283/100 |
| 2016/0339717 | A1 * | 11/2016 | Strater, Jr. | B41J 3/407 |
| 2017/0209781 | A1 * | 7/2017 | Gaynor | B41J 3/01 |
| 2017/0213425 | A1 | 7/2017 | Weil et al. | |
| 2018/0020126 | A1 * | 1/2018 | Weil | A63F 3/0655 |

OTHER PUBLICATIONS

"Combined Search and Examination Report", from corresponding Great Britain patent application No. GB2110065.6, dated Jan. 14, 2022.

"Combined Search and Examination Report", from corresponding Great Britain Patent Application No. GB2218476.6, dated Jan. 16, 2023.

* cited by examiner

APPLYING IMAGING SPECIALTY INKS TO SCRATCH-OFF DOCUMENTS

PRIORITY CLAIM

This application claims priority to and the benefit of U.S. Provisional Patent Application No. 63/052,097 filed Jul. 15, 2020, the entire contents of which is hereby incorporated by reference.

BACKGROUND

The present disclosure relates generally to documents (such as but not limited to lottery tickets, telephone cards, or gift cards) having variable indicia under a Scratch-Off Coating (SOC), and more particularly to methods for imaging foil patterns onto the substrate or coatings thereon of the scratch-off document. In various embodiments, digital applications of specialty inks (e.g., fluorescence, infrared, general security) are also disclosed.

Lottery scratch-off or instant games have become a time-honored method of raising revenue for state and federal governments the world over. The concept of hiding predetermined win or lose indicia information under a Scratch-Off-Coating (SOC) or other medium (e.g., tear away tabs) has also been applied to numerous products such as commercial contests, tribal gaming, etc. Literally, tens of billions of variable indicia reveal products are produced every year where Scratch-Off-Coatings (SOCs) or other medium are used to ensure that the product has not been previously used, played, or modified.

In an attempt to diversify their base and increase sales, United States lotteries have come to appreciate the virtues of producing games with more entertainment value that can be sold at a premium price. For example, ten-dollar instant ticket games with higher paybacks and more ways to win now account for billions of dollars a year in United States lottery sales. But these higher priced and high-volume games also add little perceived value relative to lower priced instant tickets and consequently may not attract many new consumers, partially because it is difficult to convey a differentiating premium status on a scratch-off document.

BRIEF SUMMARY

In various embodiments, the present disclosure resolves the problem of conveying a differentiating premium status on scratch-off documents by digitally applying foil-based coatings and/or inks to the substrate or coatings thereon of the scratch-off document. Various embodiments of the present disclosure can be associated with lottery games (e.g., instant tickets), telephone activation cards, or gift cards, or any other document with variable indicia secured by a Scratch-Off Coating (SOC).

A first general aspect of this disclosure relates to a security-enhanced scratch-off document comprising: a substrate; lower security layers on the substrate; at least one lower portion of variable indicia digitally imaged on the substrate over the lower security layers; at least one release coat applied over the variable indicia; one optional upper opacity layer applied over the release coat to maintain the lower portion imaging unreadable until removal; at least one optional high-contrast SOC; a decorative overprint; and at least one overprint upper portion with specialty ink imaging and a subsequent second surface material over the decorative overprint, the subsequent second surface material covering at least a part of the decorative overprint portion.

In a first embodiment of this disclosure, a specialty ink adhesive is applied via ink jet over the SOC and associated decorative overprint as well as, optionally, other portions of the substrate. The adhesive providing a base to selectively connect portions of a second surface material (e.g., cold foil, plastic) to the substrate such that the adhesive and associated second surface material will scratch-off when the SOC is removed by a consumer and/or remain intact on the other (non-scratch-off) portions of the document.

In a specific aspect of the first embodiment, the specialty ink adhesive is applied via ink jet directly on the second surface material (e.g., cold foil) and then placed in contact with the SOC as well as, optionally, other portions of the substrate. As before, the adhesive provides a base to selectively connect portions of the second surface material to the SOC such that the adhesive and portions of the second surface material will scratch-off when the SOC is removed by a consumer. Various such embodiments have the advantage of the specialty ink adhesive being applied to the second surface material which is non-porous and homogeneous resulting in uniform adhesive absorption. In an alternate embodiment, the specialty ink adhesive is applied via ink jet directly on the second surface material in addition to the SOC and prior to being placed in contact with each other.

In another specific aspect of the first embodiment, the specialty ink adhesive is applied via ink jet over the SOC and associated decorative overprint and/or other portions of the substrate. The adhesive providing a base in this specific aspect to selectively attach fine flakes of metal pigment carried by a silicone-coated donor roller to the substrate such that the adhesive and associated metal pigment flakes will scratch-off when the SOC is removed by a consumer and/or remain intact on the other (non-scratch-off) portions of the substrate.

In a second embodiment, the specialty ink adhesive that is applied via ink jet over the SOC area is synchronized with the display portion and/or lower variable indicia and, such that the specialty ink adhesive applied has at least one associated feature imaged with respect to a visual or thematic aspect of the lower portion(s). This embodiment has an advantage of variability of the specialty ink adhesive with respect to the lower portion(s) thereby greatly enhancing document and/or game design.

In an alternative embodiment, the specialty ink adhesive is applied directly to the release coat or the opacity layer rather than SOC with the second surface material applied on top of the adhesive. With this alternative embodiment, the second medium effectively becomes a digital application (i.e., infinitely variable) SOC itself, rather than a decorative trim. In the distinct embodiment where the specialty ink adhesive is applied directly to the release coat, the second surface material would also function as an opacity security layer(s) as well as SOC.

In another alternative embodiment, the specialty ink adhesive is applied directly to the lower security layers with the second surface material applied on top of the adhesive and a separate release coat ink film applied over the retained second surface material. With this alternative embodiment, the digitally imaged specialty ink adhesive and associated second surface material can function as variable indicia denoting the winning or losing status of a scratch-off document such as a scratch-off lottery ticket.

In a second general aspect of this disclosure, a specialty ink is applied to the lower portion graphic imaging (e.g., display portion, variable indicia) as a fifth color and/or the SOC and decorative overprint—i.e., in addition to the standard four-color process colors of Cyan, Magenta, Yellow, and blacK (CMYK). In a specific embodiment, the specialty ink is a dye based color in addition to the pigmented based process colors. In certain embodiments, the fifth color dye based ink is a black color that visually resembles the pigmented black process color under white light illumination, but under infrared (IR) illumination the dye based black disappears while the pigmented black still remains visible. In this embodiment, the dye based and pigmented based black inks could be printed intermingled or on different portions of the same surface creating a covert security feature protecting against forgeries. This security feature should be detectable only under illumination sources other than white light.

Described are a number of mechanisms and methodologies that provide practical details for reliably applying specialty inks to scratch-off tickets or other documents. Although the examples provided herein are primarily related to instant lottery tickets, it is clear that this disclosure is applicable to any type of scratch-off specialized games or other security-enhanced documents.

BRIEF DESCRIPTION OF THE SEVERAL VIEWS OF THE DRAWINGS

The foregoing summary, as well as the following detailed description of the present disclosure, will be better understood when read in conjunction with the appended drawings. For the purpose of illustrating example embodiments of the present disclosure, there are shown in the drawings various embodiments. It should be understood, however, that the present disclosure is not limited to the precise arrangements and instrumentalities shown. In the drawings.

DETAILED DESCRIPTION

Certain terminology is used herein for convenience only and is not to be taken as a limitation on the present disclosure. The words "a" and "an", as used in the claims and in the corresponding portions of the specification, mean "at least one." The terms "scratch-off game piece" or other "scratch-off document," hereinafter is referred to generally as an "instant ticket" or simply "ticket." Additionally, the terms "full-color" and "process color" are also used interchangeably throughout the specification as terms of convenience for producing a variety of colors by discrete combinations of applications of primary pigmented inks or dyes "CMYK" (i.e., Cyan, Magenta, Yellow, and blacK), or in some cases six colors (e.g., Hexachrome printing process uses CMYK inks plus Orange and Green inks), or alternatively eight colors—e.g., CMYK plus lighter shades of cyan (LC), magenta (LM), yellow (LY), and black (YK).

Also, as used herein, the terms "multi" or "multiple" or similar terms means at least two, and may also mean three, four, or more, for example, unless otherwise indicated in the context of the use of the terms. Also, "variable" indicium or indicia refers to imaged indicia which indicates information relating a property, such as, without limit, a value of the document, for example, a lottery ticket, coupon, or commercial game piece or the like, where the variable indicium or indicia is or are ultimately hidden by a SOC until the information or value is authorized to be seen, such as by a purchaser of the document who scratches off the SOC, revealing the variable indicium or indicia. Examples of variable indicium as a printed embodiment include letters, numbers, icons, or figures.

In the context of this disclosure, the term "variable imaging," refers to methods of printing a digital-based image directly to a variety of documents and/or layers having a SOC (e.g., instant lottery ticket). Thus, as its name implies, "variable imaging" can vary from document-to-document and can include text, icons, drawings, photographs, etc.

Before describing the present disclosure, it is useful to first provide a brief description of prior art construction of a scratch-off document to ensure that a common lexicon is understood. This prior art description of scratch-off document construction is provided in relation to FIGS. 1A and 1B.

Figure 1A:
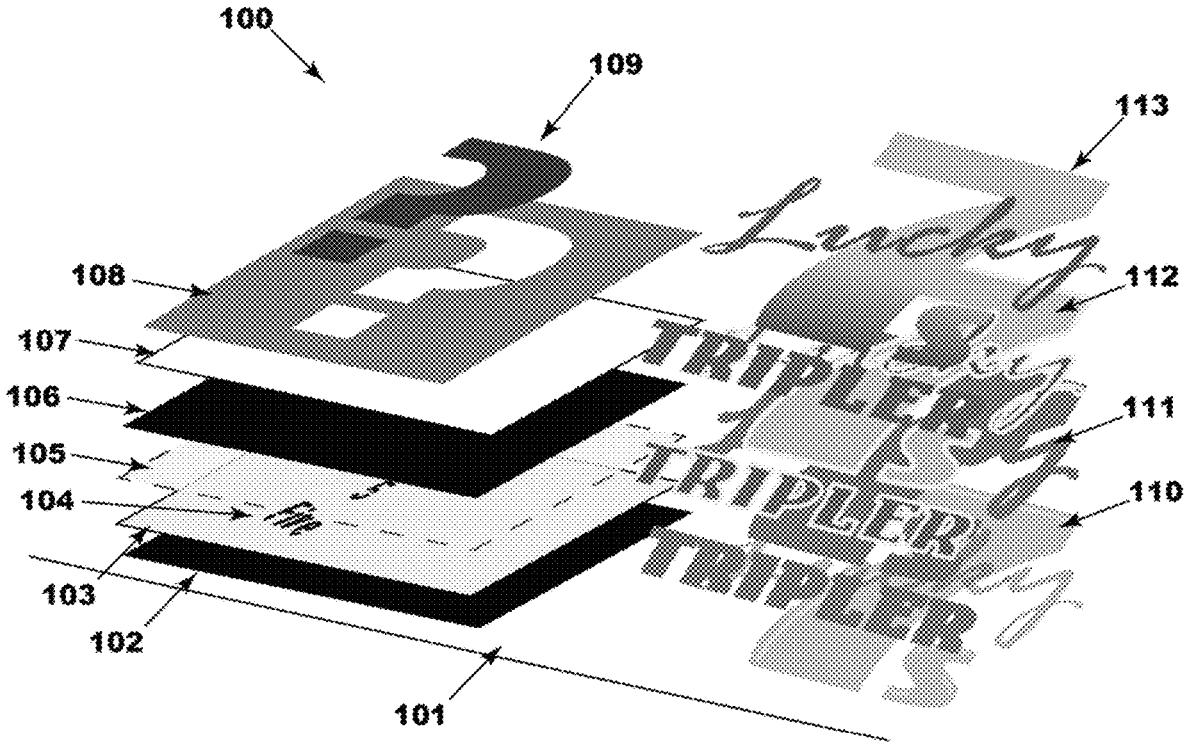
FIG. 1A PRIOR ART
FIG. 1A is an exploded top isometric view of a prior art representative example of a traditional lottery-type instant ticket security ink film stack where the ink jet is applied as a separate process and ink film.

FIG. 1A depicts a prior art representative example of the variable indicia and associated security ink stack typical of traditional ink jet SOC secured document, and particularly an instant lottery ticket 100. As shown in FIG. 1A, the variable printed variable indicium 104 is inserted between lower 102 and 103 and upper 105 thru 107 security ink films in an attempt to provide barriers protecting the variable indicium 104 from being readable with unsold (and thus unscratched) documents. The entire ink film stack is deposited on a paper, foil, or other substrate 101. The lower security-ink film layers provide opacity 102 and diffusion barriers as well as at least one higher contrast (e.g., white or gray) background 103 such that a human consumer can read the variable indicium 104. The upper security ink film layers also isolate the variable indicum 104, first with a release coating 105 that helps seal the variable indicia to the substrate and also causes any ink films printed on top of it to scratch-off. One or more upper opacity layer(s) 106 is/are applied to help conceal the indicum. On top of the opacity layer(s), one or more white ink film(s) 107 is/are applied to provide a higher contrast background for overprint inks. Finally, decorative overprint inks 108 and 109 are applied for both an attractive appearance of the SOC area as well as sometimes providing additional security. In addition to the security ink stack (102 thru 109) and variable indicum 104 of ticket 100, there is also decorative display (110 thru 113) printing configured to make the ticket 100 more attractive and provide instructions for game play. This display printing is printed via an offset or flexographic (i.e., fixed printing plate) process where process colors Cyan 110, Magenta 111, Yellow 112, and blacK 113 (i.e., CMYK) are blended in varying intensity to mimic all colors perceived by a human.

Thus, with the vast majority of prior art, a large quantity of security ink film layers (seven in the example of FIG. 1A) are required to protect and enable consumer readability of the variable indicum 104 of a traditional SOC protected document such as an instant lottery ticket. The example of FIG. 1A is one arrangement of a traditional SOC protected document security ink films, with the goal of any security ink film coating arrangement being to provide barriers to outside attempts to detect the variable indicia without removing the SOC.

Figure 1B:
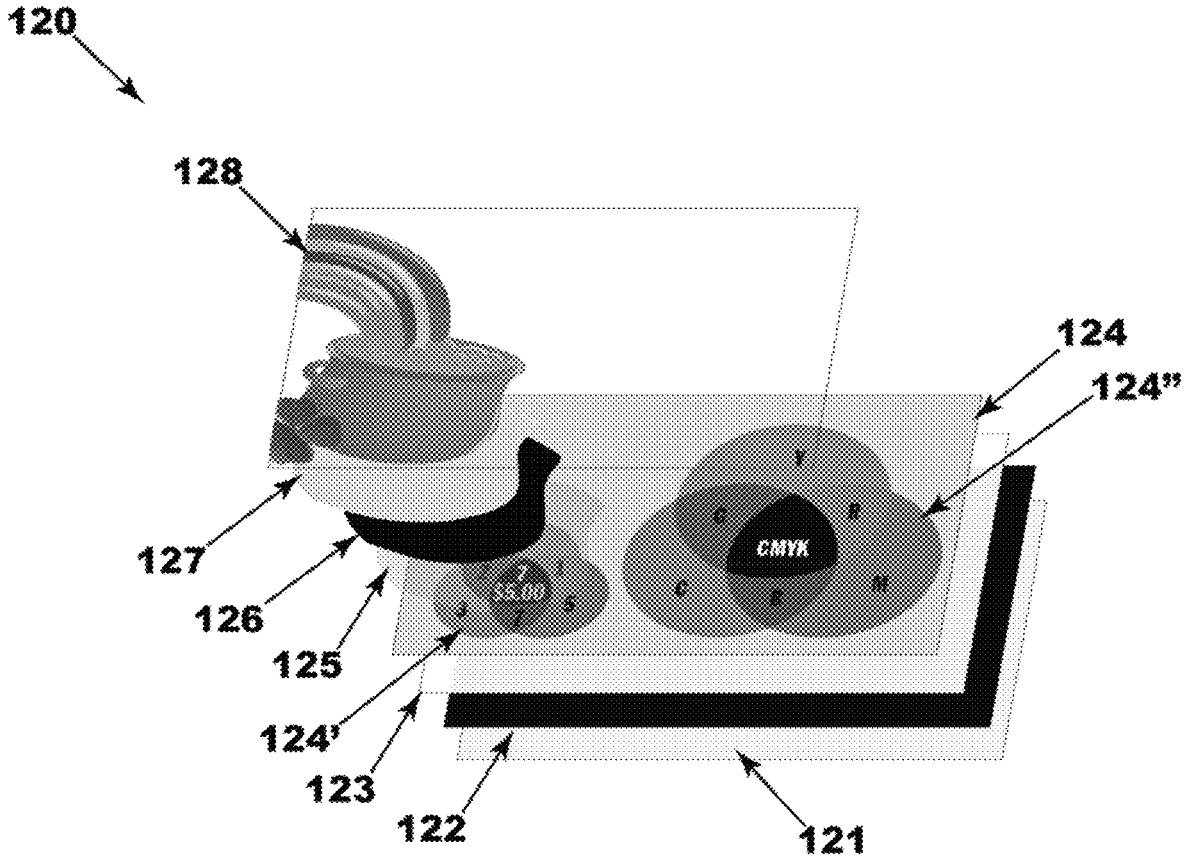
FIG. 1B PRIOR ART
FIG. 1B is an exploded top isometric view of a second prior art representative example of a lottery-type instant ticket utilizing variable indicia homogenized with the ticket display area.

While the previous discussion documents the vast majority of prior art documents manufactured, recently a new method for instant ticket construction has been developed. FIG. 1B provides a front plan view of a lottery-type instant ticket 120 security ink film stack (122, 123, and 125 thru 127) utilizing variable indicia 124' imaged with the ticket display 124" as well as a separately imaged overprint 128. As shown in FIG. 1B, the configuration of the ink security stack protecting the variable indicia 124' remains essentially the same as the existing prior art ticket 100 shown in FIG. 1A. As before, with the ticket 120 of FIG. 1B, the entire ink film stack is deposited on a paper, foil, or other substrate 121. The lower security-ink film layers provide opacity 122 and at least one higher contrast (e.g., white or gray) background 123 such that a human consumer can read the variable indicia 124'. However, with ticket 120 of FIG. 1B, both the variable indicia 124' and display 124" are imaged at the same time as one common process color ink application 124. Additionally, as illustrated in FIG. 1B, the lower security layers are flood coated (i.e., covering the entire substrate's upper surface) rather than isolated to general the area of the variable indicia.

The upper security ink film layers cover the variable indicia 124', first with a release coating 125 that helps seal the variable indicia to the substrate and also cause any ink films printed on top of it to scratch-off. One or more upper opacity layer(s) 126 is/are applied to help protect against candling and fluorescence attacks. On top of the opacity layer(s), one or more white ink film(s) 127 is/are applied to provide a higher contrast background for overprint inks with the overprint 128 imaged both as an attractive appearance of the SOC area, as well as to possibly provide additional security.

Reference will now be made in detail to examples of the present disclosure, one or more embodiments of which are illustrated in the figures. Each example is provided by way of explanation of the present disclosure, and not as a limitation of the present disclosure. For instance, features illustrated or described with respect to one embodiment can be used with another embodiment to yield still a further embodiment. It is intended that the present application encompasses these and other modifications and variations as come within the scope and spirit of the present disclosure.

Figure 1C:
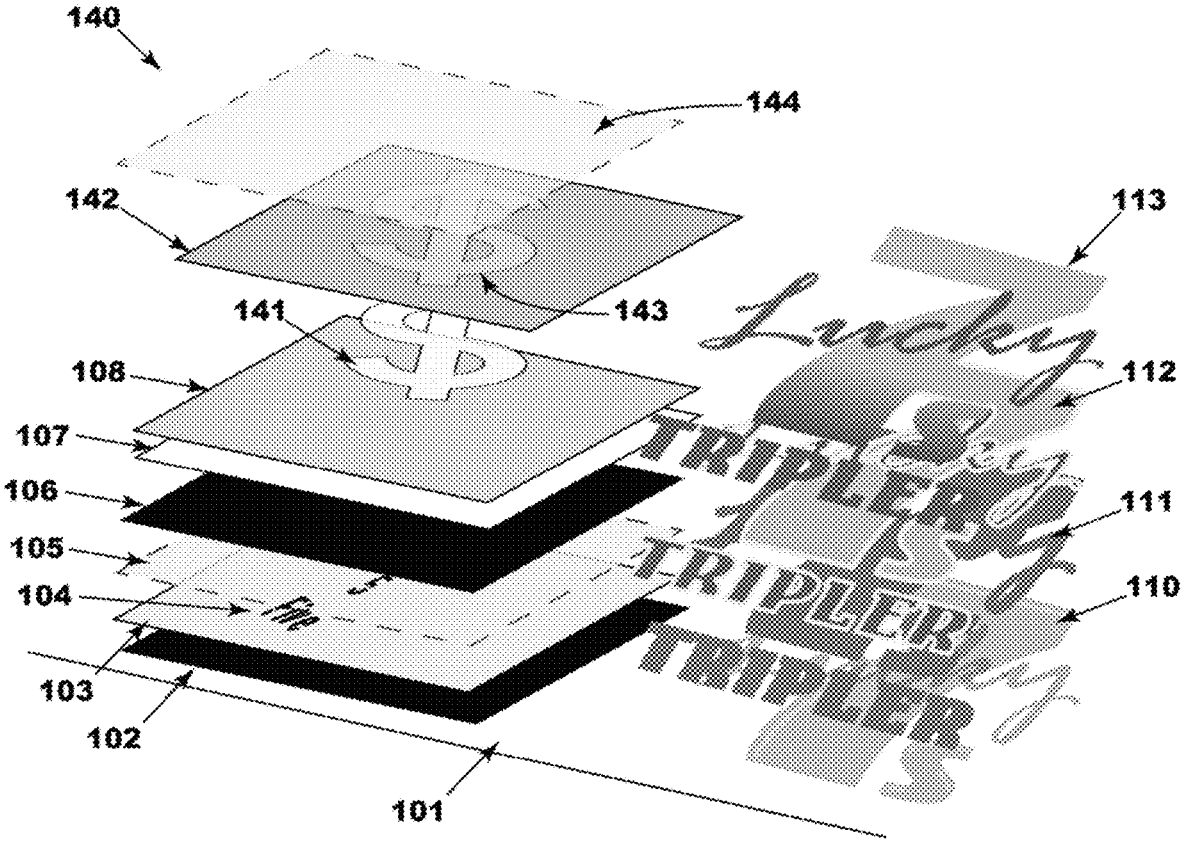
FIG. 1C is an exploded top isometric view of a first representative example of a modified lottery-type instant ticket security ink film stack utilizing a specialty ink adhesive applied via ink jet over the SOC and/or substrate with the adhesive providing a base to selectively connect portions of a separate second surface material to the SOC according to one example embodiment of the present disclosure.

FIG. 1C is an exploded top isometric view of a first representative example embodiment of a ticket 140 of the present disclosure, wherein the ticket 140 has a modified lottery-type instant ticket security ink film stack utilizing a specialty ink adhesive 141 digitally applied via ink jet over the SOC 107 thereby providing a base to selectively connect portions of a separate cold foil substrate 142 (sometimes referred to herein as a "second surface material") to the SOC such that the digitally applied specialty ink adhesive 141 and second surface material cold foil substrate 142 overlaying the specialty ink adhesive 141 will be retained to the SOC 107 and associated overprints 108 when the cold foil substrate 142 is removed. Additionally, in various embodiments, the retained cold foil substrate 143 will be configured to separate and break down to fragments when scratched by a consumer.

As illustrated in FIG. 1C, in various embodiments, the specialty ink adhesive 141 is applied via ink jet (not shown) in a suitable image such as the example image of a dollar bill "$" pattern. Thus, only portions of the second surface material cold foil substrate 142 will remain attached to where the specialty ink adhesive application was applied with other portions of the second surface material cold foil 142 remaining with the second surface material cold foil substrate. The specialty ink adhesive 141 can be applied directly to the SOC 107 and associated overprints 108, or directly to the ticket substrate 101 instead of the SOC 107, or applied to both the SOC 107 and/or overprints 108 and the ticket substrate 101. In various embodiments, the retention of portions of the second surface material cold foil 143 imparts to the ticket or other document a premium appearance that would perceivably enhance sales and justify a higher price point. A clear overprint varnish 144 (e.g., ultraviolet or "UV" cured) can be applied on top of both the retained cold foil 143 and the SOC 107, the overprints 108, and/or ticket substrate 101, thereby increasing graphic adhesion as well as imparting an attractive clear gloss to portions of the ticket or other document.

Figure 1D:
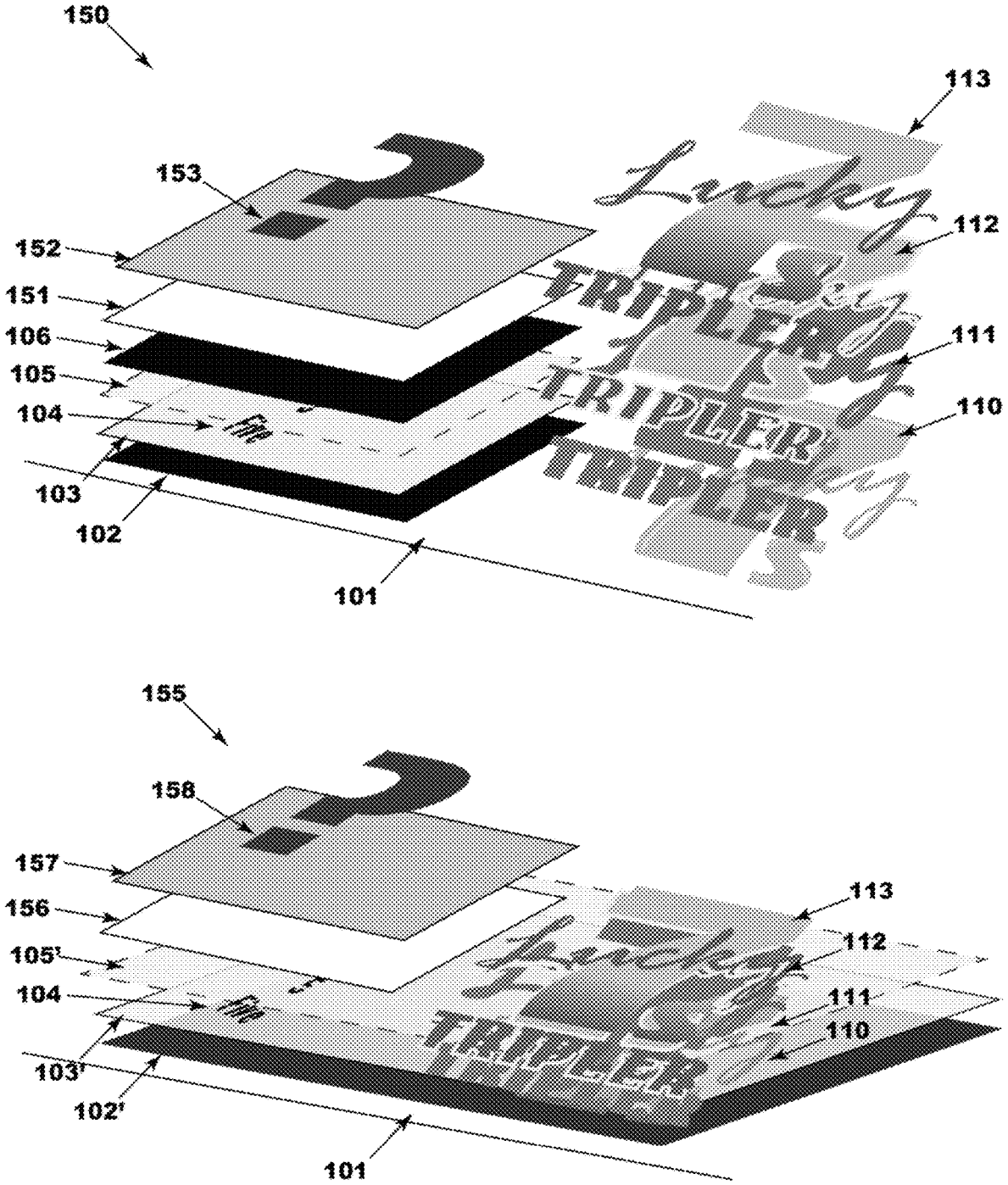
FIG. 1D is an exploded top isometric view of a second representative example of a modified lottery-type instant ticket security ink film stack utilizing a specialty ink adhesive applied with the adhesive providing a base to selectively connect portions of a separate second surface material to the release coat or opacity layer according to one example embodiment of the present disclosure.

FIG. 1D illustrates two exploded top isometric views of an example second ticket 150 and an example third ticket 155 that are representative examples of the present disclosure that provide a modified lottery-type instant ticket security ink film stack utilizing a specialty ink adhesive (151 and 156) with the adhesive providing a base to selectively connect portions of a second surface material (152 and 157) directly to the opacity layer 106 or the release coat 105' thereby enabling the second surface material (152 and 157) to function as an alternative to the SOC ink film 107 of FIG. 1C. Thus, these example embodiments differ from the previous example embodiments in a first aspect that the specialty ink adhesive 151/156 (FIG. 1D) is applied on top of either the upper opacity layer 106 or the release coat layer 105', rather than on top of the SOC 107 (FIG. 1C) as in previous embodiments. Additionally, unlike the ticket 140 of FIG. 1C, in both tickets 150 and 155 of FIG. 1D, the specialty ink adhesive 151/156 is applied to the entire security scratch-off area of the ticket that is required to conceal the variable indicia on unpurchased tickets rather than a distinctive pattern—e.g., 141 of FIG. 1C. This is necessary, because in the example embodiments of tickets 150 and 155 of FIG. 1D, the second surface material is subsequently attached to the specialty ink adhesive functions as either the SOC 107 (FIG. 1C) or the upper opacity layer 106 and the SOC 107. Additionally, with the example tickets 150 and 155 of FIG. 1D, the specialty ink adhesive can be applied by either ink jet in a similar manner to the previous embodiments or by a static plate printing process (e.g., flexographic, gravure).

The example FIG. 1D ticket 150 illustrates a lottery-type instant ticket security ink film stack from the lower opacity layer 102 through the upper opacity layer 106 with the specialty ink adhesive layer 151 applied on top of the upper opacity layer 106 and the second surface material 152 subsequently attached to the specialty ink adhesive layer 151. Additionally, a decorative overprint 153 can be applied to the second surface material 152 to further enhance the ticket's appearance. If a decorative overprint 153 is to be applied to the second surface material 152, a primer can first be applied to the second surface material 152 (not shown in FIG. 1D). Alternatively, or in addition to, the second surface material 152 can be a holographic foil with its own decretive features. Regardless of the second surface material 152 composition or associated overprint 153, the application of the specialty ink adhesive layer 151 applied on top of the upper opacity layer 106 has the advantage of defining the entire scratch-off area as a discrete region readily identifiable by the consumer because of the unique characteristics of the second surface material 152 (e.g., reflective foil, holographic foil) thereby also imparting a premium marketing brand to the ticket.

The example FIG. 1D ticket 155 differs from the example ticket 150 in that the specialty ink adhesive layer 156 is applied on top of the release coat 105' with the second surface material 157 attached to the specialty ink adhesive layer 156 in a similar manner as the ticket 150. However, since ticket 155 includes the direct application of the specialty ink adhesive layer 156 to the release coat 105' with the second surface material 157 subsequently attached to the specialty ink adhesive layer 156, the second surface material 157 therefore provides various security functions (e.g., opacity, chemical diffusion barrier, electrostatic barrier) that would be otherwise provided by the opacity layer and the SOC. Thus, the second surface material 157 accommodates the security functions while remaining easily removed by a consumer by scratching.

It should be appreciated that a single application of standard cold foil functioning as the second surface material 157 could be problematic for this purpose, since a standard cold foil has a thickness in the range of 0.002 to 0.009 inch (≈0.05 mm to ≤0.23 mm), and therefore due to the foil's thinness, tends to lack sufficient opacity for instant ticket security requirements. In one embodiment of the present disclosure, a single application of standard cold foil's "candling" (i.e., shining a very bright light thru the substrate) opacity resistance could be enhanced by increasing the opacity of the lower opacity blocking layer 102', thereby increasing the total opacity of the security ink stack "sandwich" to acceptable levels. However, while this technique may be sufficient for instant ticket security candling opacity requirements, there remains the problem of providing sufficient opacity to protect against fluorescence attacks (i.e., where the variable indicia emit or fluoresces light at a wavelength different than the excitation light source), which differ from candling attacks in that the light source is focused on the front of the ticket rather than through the substrate. The lack of sufficient opacity in the upper scratch-off region of an instant ticket can be at least partially compensated for by printing the overprint 158 with the same ink and application technique as the variable indicia 104. Additionally, the incorporation of printing the overprint 158 with the same ink and application technique as the variable indicum 104 also enhances the scratch-off coatings to other security attacks such as electrostatics and chemical diffusion.

In another alternative embodiment of the present disclosure, the lack of sufficient opacity to guard against fluorescence attacks with a single application of standard cold foil functioning as the second surface material 157, can be at least partially compensated for by forming the ticket by applying a plurality of second surface materials 157 and associated specialty ink adhesive layers 156. This alternative embodiment has the advantage of not requiring any overprint with the disadvantage of multiple second surface materials 157 and associated specialty ink adhesive layer 156 applications. In another alternative embodiment, the second surface material 157 could be made of a different (i.e., more opaque) substance than the prior art cold foil or alternatively, a thicker and consequently more opaque cold foil could be applied as the second surface material 157. However, this alternative embodiment may have the disadvantage of increasing the scratch resistance.

In another alternative embodiment, the lack of sufficient opacity to guard against fluorescence attacks with a single application of standard cold foil functioning as the second surface material 157, can be at least partially compensated for by including opacity and/or security pigmentation in the specialty ink adhesive layer 156. While it may be difficult to gain sufficient opacity with a single application of opacity and/or security pigmentation in the specialty ink adhesive layer 156, the additional opacity of the pigmented adhesive can partially contribute to the overall opacity and combined with one or more of the features of the other embodiments can achieve sufficient security.

With example ticket 155, since the specialty ink adhesive layer 156 is placed on top of the release coat 105', the release coat and lower security layers 102' and 103' can optionally be applied flood coated (i.e., covering the entire front surface) across the front of the entire substrate such as shown in the example ticket 155. In this optional case where the release coat 105' and lower security layers 102' and 103' of ticket 155 are flood coated, the digital application of the specialty ink adhesive layer(s) 156 enables virtually infinitely different variable scratch-off areas to be printed on the same print run. The release coat 105' and lower security layers 102' and 103' can also be applied spot coated (i.e., not covering the entire front surface of the ticket or other document).

Figure 1E:
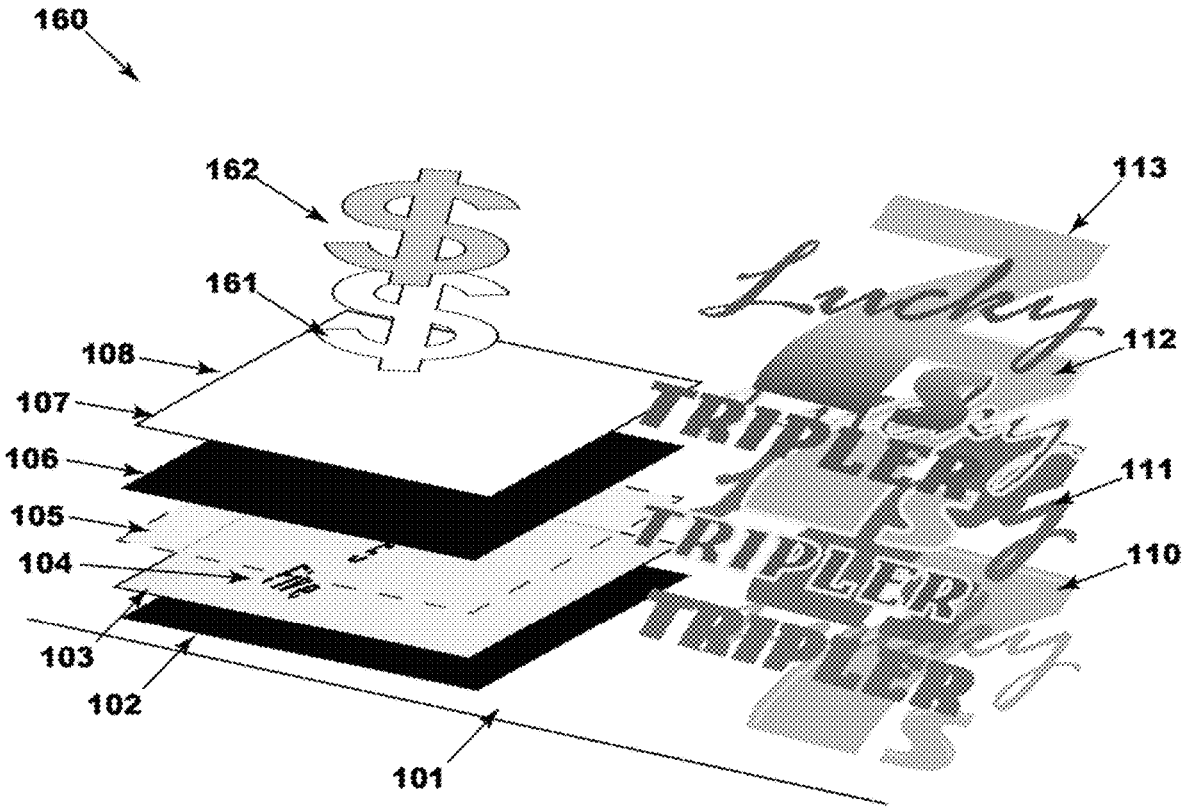
FIG. 1E is an exploded top isometric view of a third representative example of a modified lottery-type instant ticket security ink film stack utilizing a specialty metallic ink applied via ink jet over the SOC and/or substrate according to one example embodiment of the present disclosure.

FIG. 1E is an exploded top isometric view of a fourth representative example ticket 160 having a modified lottery-type instant ticket security ink film stack utilizing an adhesive layer 161 applied via ink jet over the SOC layer 108 such that fine flakes of metal pigment 162 can be retained by the adhesive layer 161 applied via a silicone coated donor roll transferring the metal flakes from a reservoir to the ticket or other document's surface. As before, the retained fine flakes of metal pigment 162 will separate and break down to fragments when the SOC is removed by a consumer.

As previously stated, the fine flakes of metal pigment 162 can be applied via a silicone coated donor roll transferring the metal flakes from a reservoir to the ticket or other document's surface (e.g., callout 330 of FIG. 3B) in the image of a dollar bill "$" pattern 161 (as shown in FIG. 1E). As before, in this embodiment, the fine flakes of metal pigment 162 and associated adhesive 161 can be applied directly to the SOC 108 and/or to the substrate 101 and/or display 110, 111, 112, and 113. The additional specialty metallic ink 161 layer conveys to the ticket or other document a premium appearance that would perceivably enhance sales and justify a higher price point.

The fine flakes of metal pigment 162 and associated adhesive 161 essentially suggests a premium appearance similar to the foil 143 of the exemplary ticket 140 as shown in FIG. 1C. However, the foil 143 of the ticket 140 can provide more visual impact including optional holographic foil, which is not possible with the metal pigment 162 and associated adhesive 161 of the ticket 160 (FIG. 1E). That said, the metal pigment 162 and associated adhesive 161 of embodiment 160 have the advantages of a substantially lower cost as well as the ability to print very fine lines. It should be appreciated that the foil, since it is extracted from a sheet, consequently has a limited ability to "hold" fine lines. Additionally, the metal pigment 162 and associated adhesive 161 of embodiment 160 are available in a wider range of colors than foil.

Figure 1F:
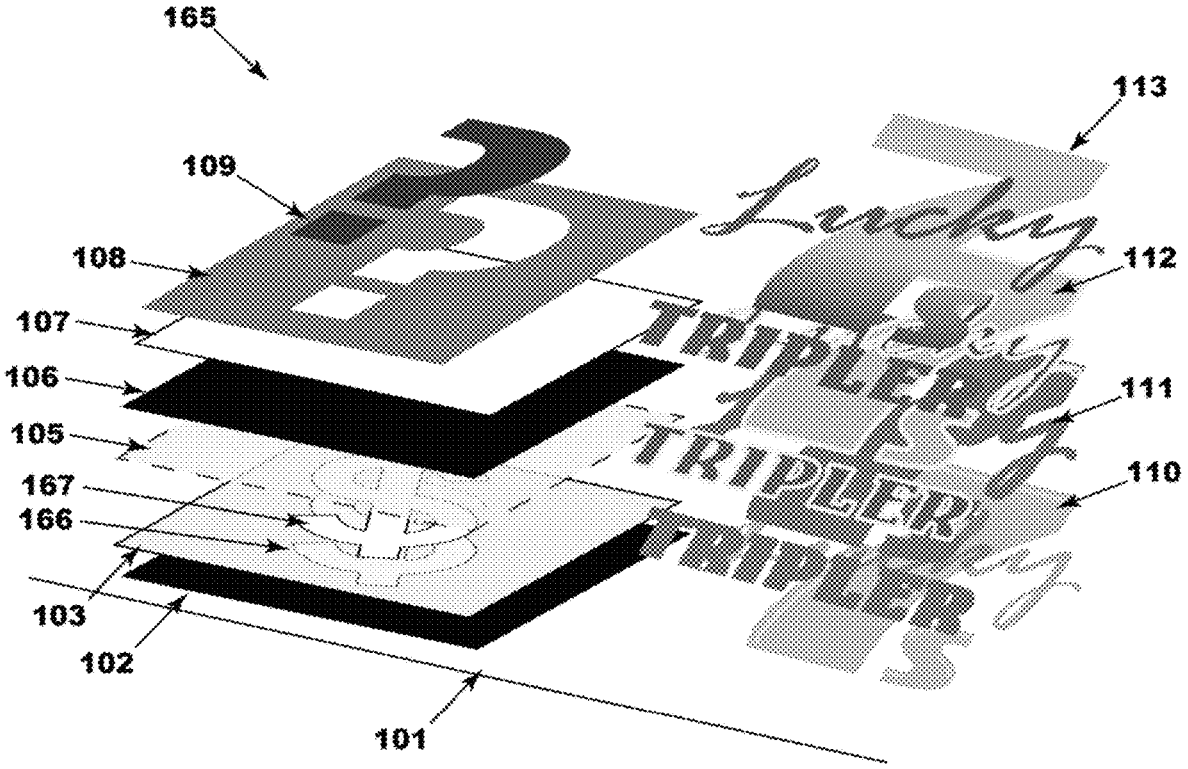
FIG. 1F is an exploded top isometric view of a fourth representative example of a modified lottery-type instant ticket security ink film stack utilizing a specialty ink adhesive applied with the adhesive providing a base to selectively connect portions of a separate second surface material to the lower security ink film layers in accordance with one example embodiment of the present disclosure.

FIG. 1F is an exploded top isometric view of a fifth representative example ticket 165 having a modified lottery-type instant ticket security ink film stack utilizing an adhesive layer 166 applied via ink jet over lower security layer 103 such that fine flakes of metal pigment 167 can be retained by the adhesive layer 166. However, in the exemplary ticket 165 of FIG. 1F, the metal pigment 167 and associated adhesive 166 are imaged as the variable indicia rather than as an overprint. Thus, with ticket 165, the metal pigmented 167 variable indicia are not necessarily visible on unplayed (i.e., unscratched) tickets. However, the scratch-off reveal of metallic appearing indicia can impart an "Easter Egg" type reveal for the consumer again imparting the perception of enhanced value, especially if the indicia is imaged with gold or silver appearing metal pigment 167 flakes.

Thus, the fine flakes of metal pigment 167 are imaged as variable indicia and subsequently covered by the release layer 105. This is possible because of the extremely small size (e.g., <50 μm or $<1.97\times10^{-3}$ inch) of the flakes of metal pigment 167, since the small size and shape of the flakes enable uniform homogeneous coverage by the direct energy cured release coat that is much thicker (e.g., >200 BCM or "Billion Cubic Microns" applied volume) than most printed inks. An optional additional seal coat layer can be applied between the release coat and the metal pigment 167 to cause the combined overlying ink film coverage to tend to be even more constant. In contrast, imaging variable indicia is generally not possible with the previous cold foil embodiments since the remaining foil substrate, while thin, is still several orders of magnitude thicker (e.g., 0.002 to 0.009 inch or ≈0.05 mm to ≈0.23 mm) than the metal pigment 167. Additionally, the residue foil substrate tends to be less receptive to being overprinted by a release coat and (optionally) seal coat.

However, the addition of metal pigments 167 as variable indicia can introduce new security risks in terms of pick out (i.e., identifying a document's value without removing the SOC). Pick out techniques such as soft X-rays, electrostatics, ultrasound, and/or infrared candling have the potential to reveal the information conveyed by metallic pigmented variable indicia 167. To prevent this, various countermeasures include similar metal pigmented particles being embedded in the opacity (e.g., 102 and 106) or overprint (e.g., 108 and 109) layers that effectively obfuscate the metal pigmented variable indicia 167 from illicit compromise techniques.

The fine flakes of metal pigment 162 and associated adhesive 161 essentially suggests a premium appearance similar to the overprint tickets 140 (FIG. 1C), 150 and 155 (FIG. 1D), and 160 (FIG. 1E). However, while the overprint tickets 140, 150, 155, and 160 can provide more visual impact for unsold (i.e., unplayed) tickets or other documents, the previously discussed "Easter Egg" type reveal for the consumer imparts the perception of enhanced value for an unique product.

Figure 2A:
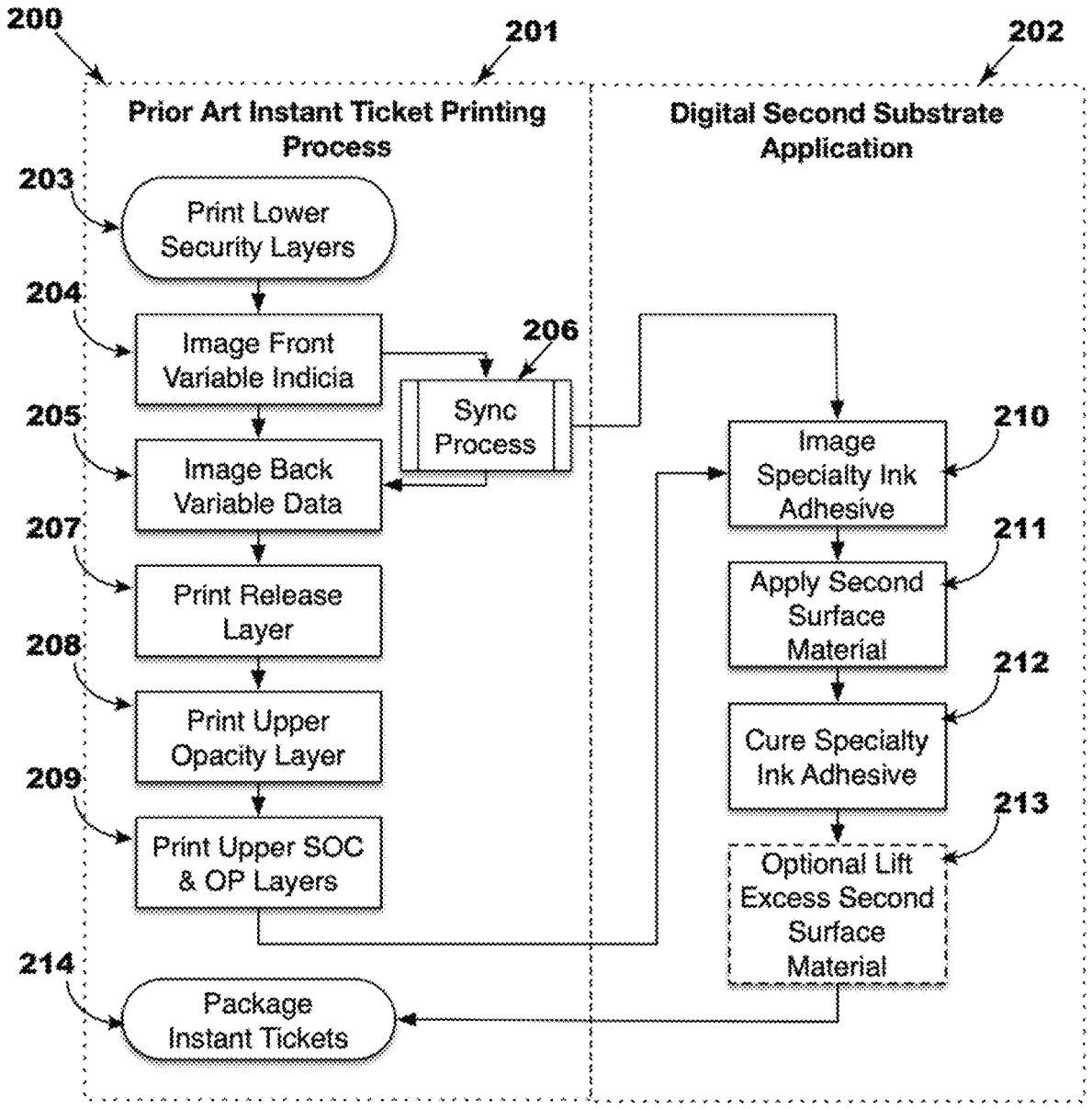
FIG. 2A is a swim lane flowchart providing a schematic graphical overview of the example embodiment of FIG. 1C for digitally ink jetting adhesive to selectively adhere a separate second surface material to portions of the SOC and/or display areas.

FIG. 2A illustrates the method of manufacturing the previously disclosed first representative ticket 140 of FIG. 1C as a swim lane flow chart 200 and showing the improvements to the prior art process. As illustrated in the swim lane flowchart 200, this embodiment of the disclosure is conceptually divided into two groups (i.e., "Prior Art Instant Ticket Printing Process" 201 and the "Digital Second Substrate Application" 202 added by the present disclosure) by the two "swim lane" columns as shown in FIG. 2A. If a particular flowchart function appears completely within a swim lane, its functionality is limited to the data category of the associated swim lane—e.g., Print Lower Security Layers 203 is exclusively processed in the Prior Art Instant Ticket Printing Process swim lane column 201. As its name implies, the Prior Art Instant Ticket Printing Process swim lane column 201 illustrates the functional steps or components that are already known in the art with the Digital Second Substrate Application swim lane column 202 highlighting various innovations of this disclosure.

The FIG. 2A swim lane flowchart 200 begins with the web substrate printed 203 with the lower security layers (e.g., 102 and 103 of FIG. 1C) to provide opacity and chemical barriers in the general area where the variable indicia will be imaged. Next, the variable indicia are imaged 204 on top of the lower security layers (104 of FIG. 1C). In one embodiment, the ticket's display region (e.g., 110 thru 113 of FIG. 1C) is also imaged at the same time with the same imager as the variable indicia. This embodiment has the advantages of full color flexibility and dynamic display with the disadvantage of requiring a process color imager for the display and variable indicia with the associated increase in complexity and costs.

Returning to FIG. 2A, the variable indicia imaging 204 process is kept in registration with the lower security layers via registration marks printed in a gutter of the web by the lower opacity layer (102 of FIG. 1C). Thus, variable indicia imaging 204 (FIG. 2A) registration need only be maintained with the lower security cylinders with no cognizance of which individual ticket or document is being printed up to this point. However, once the variable indicia imaging 204 is completed, each ticket or document becomes unique and consequently subsequent images or layers that are also unique now require additional ticket-by-ticket or document-by-document synchronization as well as registration with the fixed plate printing process. The subsequent imaging of the ticket variable back data 205 (e.g., inventory control numbers and associated barcodes) is the only other prior art process that requires this level of additional ticket-by-ticket or document-by-document synchronization 206. Normally, this level of synchronization 206 is accomplished by an unique "top of form" queue mark also printed in the gutter that repeats periodically throughout the print run with the first "top of form" queue mark (i.e., a mark that denotes the beginning of one fixed plate cylinder revolution) received by the second (back) imager signaling it to start imaging the next document in the printing queue. Given that the web path remains fixed from print-run to print-run, this relatively simplistic process enables the front variable indicia 204 and back variable data 205 imagers to reliably remain in synchronization 206.

Next, the upper security stack is printed (105 thru 109 of FIG. 1C), using a fixed plate printing process (e.g., flexographic, gravure) to protect and conceal the variable indicia. First, the release layer (105 of FIG. 1C) is printed 207 over the general area of the variable indicia using a fixed plate printing process. It should be noted that the term "release layer" is somewhat deceiving since the "release layer" is two different layers, the first layer being a clear or translucent water based seal coat with a second clear or translucent direct energy cured (e.g., Ultraviolet or "UV", electron beam) layer applied next that creates a hard surface for subsequent layers to scratch-off. After the release layer(s) are printed 207, at least one water based upper opacity layer (106 of FIG. 1C) is printed 208, also with a fixed printing plate process. Finally, in the traditional prior art process, the upper water based SOC (107 of FIG. 1C) and Over Print ("OP"—108 and 109 of FIG. 1C) layers are applied 209. If a process color imager is utilized to print both the variable indicia and display, then the OP would only cover the SOC portion; otherwise, the OP would cover both the SOC and display portions with preferably process colors. Since the upper security stack is printed with fixed plates and therefore repeated periodically throughout the print run, only fixed plate registration need be maintained with the other portions of the press with no requirement for ticket-to-ticket or document-to-document synchronization.

At this stage, the swim lane flowchart 200 departs from traditional fabrication and incorporates certain innovations of this disclosure. As the first step of the disclosed innovation, a digital imager (e.g., ink jet) applies 210 a specialty ink adhesive layer (141 of FIG. 1C) in anyone of the following applications:

The specialty ink adhesive layer is applied only to the SOC (optionally also portions of the display area) of the ticket or document The specialty ink adhesive layer is applied only to the second surface material The specialty ink adhesive layer is applied to both the SOC (optionally also portions of the display area) as well as the second surface material Since the specialty ink adhesive is digitally imaged to the ticket or document surface and/or the second surface material, the digital application of the specialty ink adhesive imager 210 can be in synchronization 206 with the first variable indicia imager as well as in registration with the variable indicia imager and other portions of the printing press. In a first embodiment, this synchronization 206 could be achieved in a similar manner to the synchronization process of the front variable indicia imager and the back variable data imager—i.e., by a combination of a unique "top of form" queue mark and a fixed web distance from the front and back imager. However, while this synchronization 206 methodology has been successfully employed in the past, the innovation of adding a digitally imaged specialty ink adhesive 210 after the SOC and overprints are completed 209 poses potential challenges that may not be compatible with this relatively simplistic form of synchronization—e.g., the printing web length may vary from print run to print run due to the quantity of printing units employed between the variable indicia imager and the specialty ink adhesive imager, the long web path may introduce delays sufficient for the specialty ink adhesive imager to time out, the Raster Image Processor (RIP) associated with the specialty ink adhesive imager may require file transfers or other signals from the variable indicia imager, etc. Consequently, in a second embodiment, synchronization 206 is maintained between the variable indicia imager and the specialty ink adhesive imager by the variable indicia imager supplying a document count variable to the specialty ink adhesive imager that would therefore enable variations in the web length between the variable indicia imager and the specialty ink adhesive imager. Ideally, this document count variable would be initialized by a signal from the variable indicia imager to the specialty ink adhesive imager when the variable indicia imager printed its first or some another a priori ticket or document in the printing queue. Optionally, the speed and timing of the web(s) could be monitored in addition to timing signals and variables. Alternatively, in a third embodiment, the variable indicia imager can render a queue mark in the gutter of the web that certifies a sequential document number (or some portion of an overall document number—e.g., least significant digits) that is readable by the specialty ink adhesive imager, thereby enabling it to maintain synchronization with the variable indicia imager.

Regardless of the method of synchronizing the variable indicia and the specialty ink adhesive imagers, the specialty ink adhesive is imaged onto the second surface material; alternatively, the specialty ink adhesive can be imaged onto the ticket or document or both the second surface material and the ticket or document. After the specialty ink adhesive is applied to at least one of these surfaces, the second surface material is placed in direct contact 211 with the ticket or document with a nip roller. At this point, the specialty ink adhesive is cured 212, such as with direct UV energy applied through the second surface material itself. In one embodiment, the curing 212 of the specialty ink adhesive is accomplished in a two stage process as with the adhesive undergoing a partial "precure" shortly after the initial application 210.

Irrespective of the curing process 212, the portions of the second surface material that are in direct contact with the specialty ink adhesive area(s) become affixed to the ticket or document's surface after curing 212 with the excess second surface material portions lifted away by a rollback mechanism 213. The completely printed tickets or documents are then forwarded to a packaging line for finishing 214. If the second surface material 211 are fine flakes of metal pigment 162 applied by a silicone coated donor roll transferring the metal flakes from a reservoir to the ticket or document's surface (as disclosed in FIG. 1E), the cured metal flakes are forwarded directly to packaging 214 (FIG. 2A) without the need for the optional lift process 213. Additionally, a clear overprint (direct energy UV cured) can be applied to enhance the appearance and/or the graphic adhesion of the metal flakes or foil overprints.

Thus, the embodiments 200 of FIG. 2A enable a digitally imaged second surface material to be affixed to a ticket or document with variable patterns that can be synchronized to the variable indicia imager. While this innovation creates premium marketing and differentiation for scratch-off tickets or documents, the core technology can be expanded in other embodiments to enable digital imaging of the entire scratch-off portion of tickets or documents. These embodiments could therefore enable completely variable tickets or documents within the same press run.

Figure 2B:
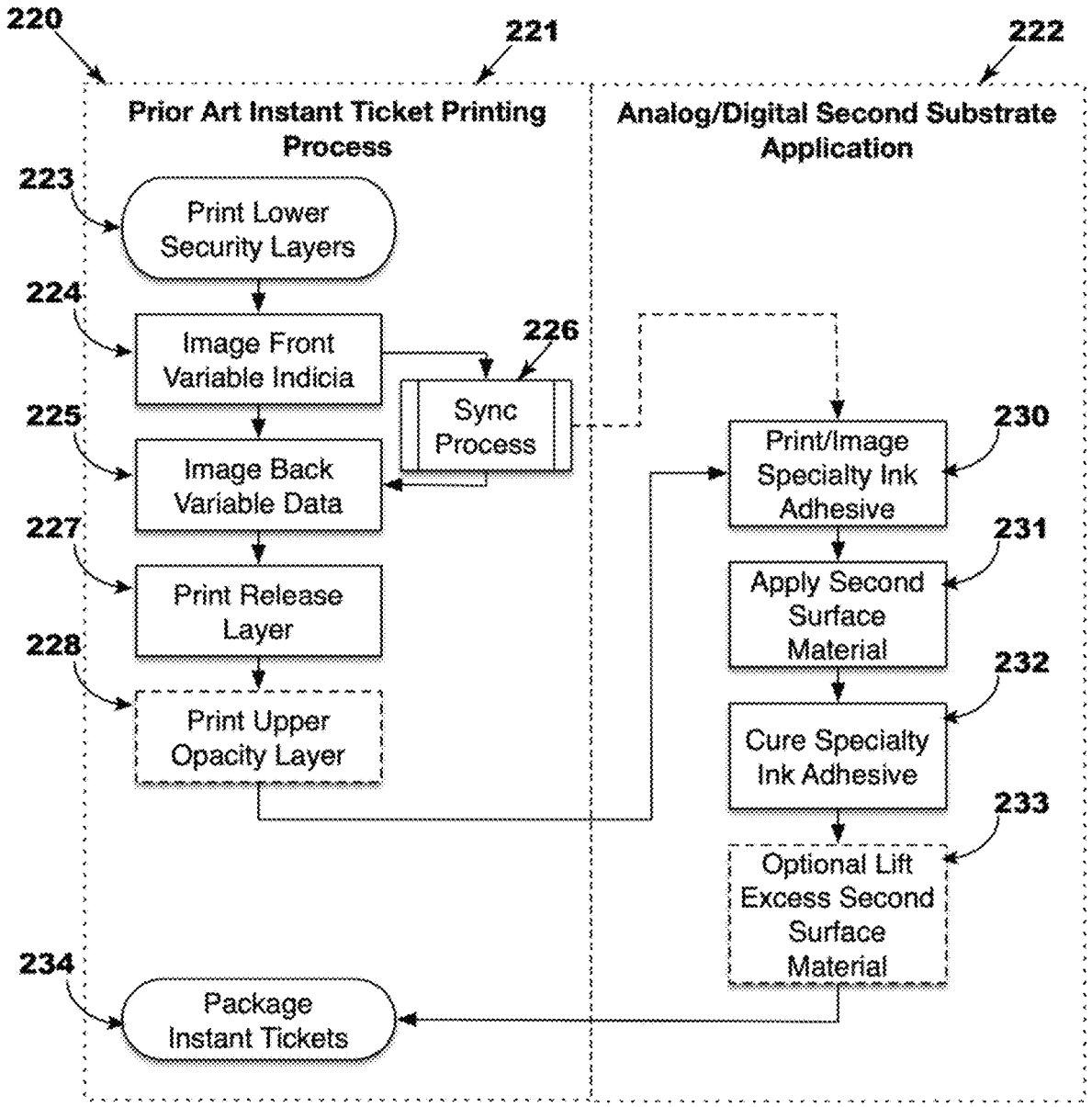
FIG. 2B is a swim lane flowchart providing a schematic graphical overview of the example embodiment of FIG. 1D for applying adhesive to selectively adhere a separate second surface material to the upper opacity or release layers.

FIG. 2B illustrates the previously disclosed second representative example tickets 150 and 155 of the disclosure of FIG. 1D as a swim lane flow chart 220. As illustrated in the swim lane flowchart 220, these embodiments of the disclosure are conceptually divided into two groups (i.e., "Prior Art Instant Ticket Printing Process" 221 and "Digital Second Substrate Application" 222) by the two "swim lane" columns as shown in FIG. 2B. As before, if a particular flowchart function appears completely within a swim lane, its functionality is limited to the data category of the associated swim lane. Again, as its name implies, the Prior Art Instant Ticket Printing Process swim lane column 221 illustrates the functional steps or components that are already known in the art with the Digital Second Substrate Application swim lane column 222 highlighting the innovations of this disclosure.

As before, the FIG. 2B swim lane flowchart 220 begins with the web substrate printed 223 with the lower security layers (e.g., 102 and 103 of FIG. 1D) to provide opacity and chemical barriers in the general area where the variable indicia will be imaged. However, with ticket 155 it may be preferable to flood coat the lower security layers across the substrate to enable complete flexibility in the placement of the imaging of the variable indicia.

Next, the variable indicia are imaged 224 on top of the lower security layers (104 of FIG. 1D). In a special embodiment, the ticket's display portion (e.g., 110 thru 113 of FIG. 1D) is also imaged at the same time with the same imager as the variable indicia. As previously discussed, the variable indicia imaging 224 process is kept in registration with the lower security layers via registration marks printed in a gutter of the web by the lower opacity layer (102 of FIG. 1D). Once the variable indicia imaging 224 is completed, each ticket or document becomes unique and consequently the subsequent variable back data 225 imaging that are also unique will be synchronized on a ticket-by-ticket or document-by-document basis 226 with the output of the variable indicia imager.

Next, the release layer(s) (105 of FIG. 1D) is/are printed 227 using a fixed plate printing process. For ticket 150 (FIG. 1D), the release layer(s) can cover the general area of the variable indicia. For ticket 155 (FIG. 1D), the release layer(s) are printed flood coated, thereby covering the entire front of the ticket or other document. As before, there are optionally two release layers, the first layer being a clear or translucent water based seal coat with a second clear or translucent direct energy cured layer applied next that creates a hard surface for subsequent layers to scratch-off.

In a first optional alternative embodiment of the ticket of 150 (FIG. 1D), after the release layer(s) are printed 227 (FIG. 2B), at least one water based upper opacity layer (106 of FIG. 1D) is printed 228 (FIG. 2B) with a fixed printing plate process over the general area of the variable indicia (104 of FIG. 1D). In a second optional alternative embodiment of ticket 155 (FIG. 1D), the specialty ink adhesive layer 156 and associated second surface material 157 function as the opacity and chemical barrier layer and are therefore applied directly on top 228 (FIG. 2B) of the release coat 227. Though, if the release and lower security layers were flood coated with both the display and variable indicia digitally imaged, the placement of the variable indicia and correspondingly the specialty ink adhesive 230 and second surface material 231 layers may vary from ticket-to-ticket or document-to-document so long as the variable indicia and specialty ink adhesive imagers remain in synchronization. After the specialty ink adhesive is applied, the second surface material is placed in direct contact 231 with the ticket or document with a nip roller and cured as before with the completely printed tickets or documents are then forwarded to a packaging line for finishing 234.

In a first embodiment, the swim lane flowchart 220 departs from prior art traditional fabrication and applies 230 a specialty ink adhesive layer (151 of FIG. 1D) on top of the upper opacity layer (106 of FIG. 1D). In an alternative embodiment, the specialty ink adhesive layer is applied 230 (FIG. 2B) by a fixed plate printing process (e.g., flexographic, gravure) directly on the opacity layer(s). This alternative embodiment has the advantages of an inexpensive and simplistic application with the disadvantage of loss of flexibility in placement. However, since the opacity layer(s) are printed with a fixed plate process, the loss of flexibility is probably less significant than with previous embodiments. A second alternative embodiment is possible by applying the specialty ink adhesive layer 230 to the upper opacity layer(s) via a digital imager. Irrespective of the type of application, the specialty ink adhesive layer (151 of FIG. 1D) can be applied in any one of the following methodologies:

- The specialty ink adhesive layer is applied only to the release or upper opacity layer(s) of the ticket or document (optionally also portions of the display area);
- The specialty ink adhesive layer is applied only to the second surface material; or
- The specialty ink adhesive layer is applied to both the SOC (optionally also portions of the display area) as well as the second surface material.

After the specialty ink adhesive is applied to at least one of these surfaces, the second surface material is placed in direct contact 231 (FIG. 2B) with the ticket or document with a nip roller. At this point, the specialty ink adhesive is cured 232, preferably with direct UV energy applied through the second surface material. In a specific embodiment, the curing 232 of the specialty ink adhesive is accomplished in a two stage process. Irrespective of the curing process 232, the portions of the second surface material that are in direct contact with the specialty ink adhesive area(s) become affixed to the ticket or document's surface after curing 232 with the excess second surface material portions lifted away by a rollback mechanism 233. The completely printed tickets or documents are then forwarded to a packaging line for finishing 234.

Figure 2C:
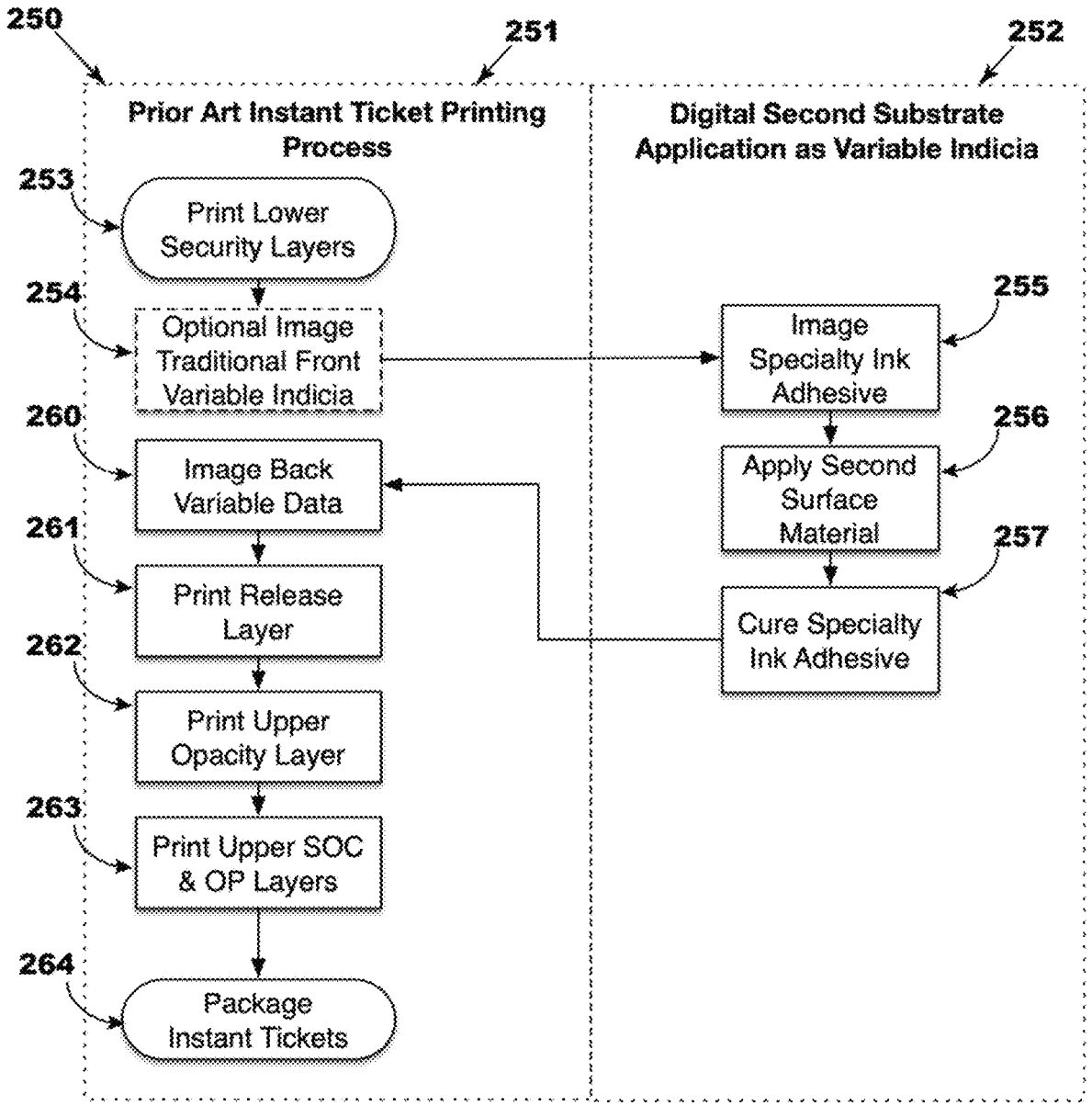
FIG. 2C is a swim lane flowchart providing a schematic graphical overview of the example embodiment of FIG. 1F for applying adhesive to selectively adhere a separate second surface material to function as variable indicia.

FIG. 2C illustrates the previously disclosed second representative example 165 of the disclosure of FIG. 1F as a swim lane flow chart 250 (FIG. 2C). As illustrated in the swim lane flowchart 250, this embodiment of the disclosure is conceptually divided into two groups (i.e., "Prior Art Instant Ticket Printing Process" 251 and "Digital Second Substrate Application as Variable Indicia" 252) by the two "swim lane" columns as shown in FIG. 2C. As before, if a particular flowchart function appears completely within a swim lane, its functionality is limited to the data category of the associated swim lane. Again, as its name implies, the Prior Art Instant Ticket Printing Process swim lane column 251 illustrates the functional steps or components that are already known in the art with the Digital Second Substrate Application as Variable Indicia swim lane column 252 highlighting the innovations of this disclosure.

As before, the FIG. 2C swim lane flowchart 250 begins with the web substrate printed 253 with the lower security layers (e.g., 102 and 103 of FIG. 1F) to provide opacity and chemical barriers in the general area where the variable indicia will be imaged. Next, the variable indicia are imaged 254 and 255 (FIG. 2C) on top of the lower security layers. However, with embodiment 250 the variable indicia are primarily imaged with the specialty ink adhesive 255 and optionally with a known front ink jet imager 254 (i.e., monochromatic or process color). Thus, in this embodiment, the printed variable indicia can be either exclusively metallic appearing or a combination of metallic appearing and known ink jet (monochromatic or process color). As previously discussed, the variable indicia imaging 255 and optionally known front ink jet imaging 254 are kept in registration with the lower security layers via registration marks printed in a gutter of the web by the lower opacity layer (102 of FIG. 1D). However, with the example embodiment of the exemplary ticket 250 (FIG. 2C), at least a portion of the variable indicia are imaged with metallic ink 255, consequently it may be necessary to modify the lower security layers with countermeasures to ensure the security of the variable indicia against "pick out" attacks that are optimized to detect the metallic ink 255. These types of attacks exploit the unique nature of the metallic ink 255 in an attempt to covertly identify the variable indicia through the back of the ticket. For example, soft x-rays, ultrasound, and/or electrostatics can be employed for this illicit purpose. Fortunately, an effective countermeasure to these types of attacks is to simply include metallic flakes (e.g., aluminum) in the lower security coatings.

Returning to FIG. 2C, a second surface metallic material (e.g., fine flakes of metal pigment) is applied 256 and then cured 257 thereby adhering the metallic appearing variable indicia to the document. Once the variable indicia imaging (255 and optionally 254) is completed, each ticket or document becomes unique and consequently the subsequent variable back data 260 imaging that are also unique will be synchronized on a ticket-by-ticket or document-by-document basis with the output of the variable indicia imager.

Next, the release layer(s) (105 of FIG. 1F) is/are printed 261 (FIG. 2C) using a fixed plate printing process. In the embodiment of FIG. 1F, the release layer(s) can cover the general area of the variable indicia with optionally release layer(s) printed flood coated, thereby covering the entire front of the ticket or document. As before, there are optionally two release layers, the first layer being a clear or translucent water based seal coat with a second clear or translucent direct energy cured layer applied next on top that creates a hard clear surface for subsequent layers to scratch-off. On top of the release layer(s) at least one opacity layer is printed 262 (FIG. 2C) immediately followed by an application of the SOC ink film and associated overprints (OP) 263. As previously disclosed, one of the overprints could also be a secondary foil application with the advantage of enhanced security due to the secondary foil OP application being of similar material to the metallic variable indicia thereby creating a homogeneous secondary countermeasure against pick out attacks. As with the lower security layers, in certain embodiments an effective countermeasure to these types of attacks is to simply include metallic flakes (e.g., aluminum) in the upper security coatings (e.g., the upper opacity layer 106 and/or the SOC 107 of FIG. 1F). After the SOC and OP layers are applied 263 (FIG. 2C), the completely printed tickets or documents are then forwarded to a packaging line for finishing 264.

Figure 3A:
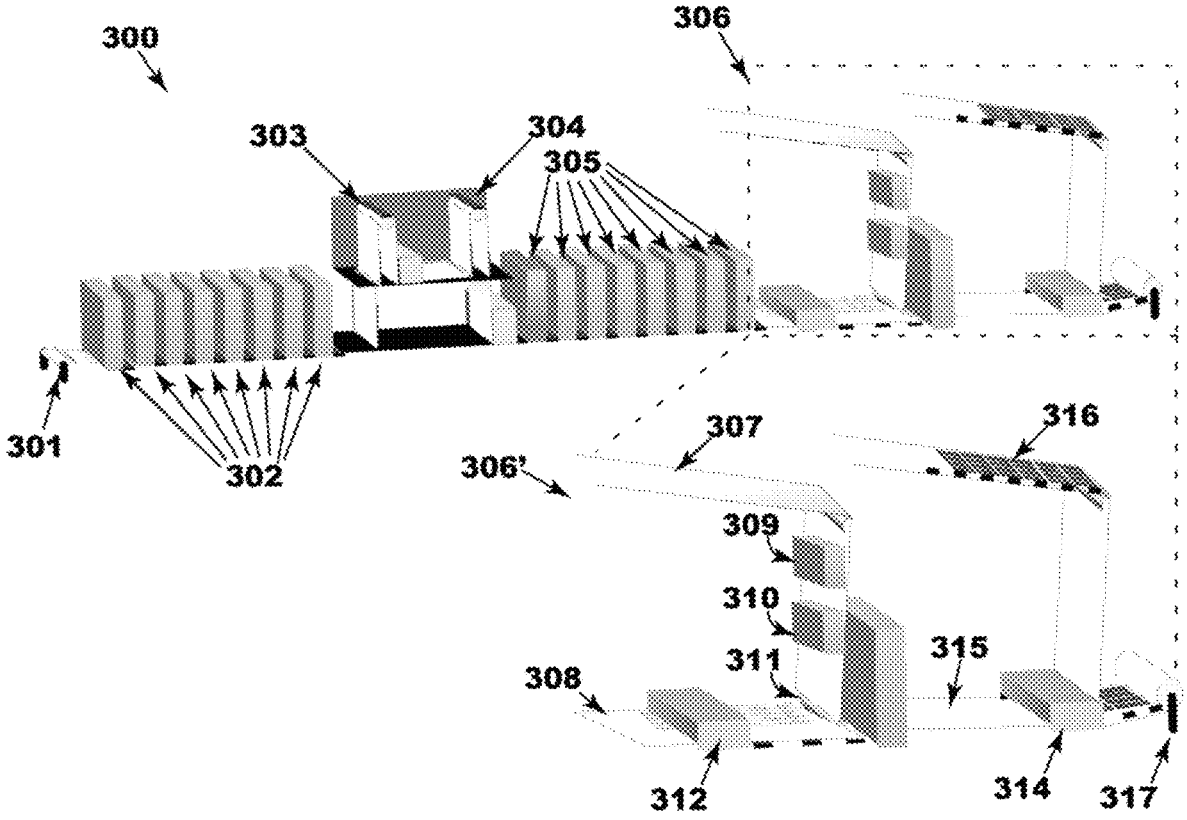
FIG. 3A is a schematic view of a first representative example of a digital press configuration capable of printing one example embodiment of the modified scratch-off ticket or document of FIGS. 1C and 1D.

One possible press configuration 300 capable of producing the specialty ink adhesive and second surface material scratch-off ticket or document embodiments of FIGS. 1C, 1D, and 2A is illustrated in FIG. 3A. As shown in FIG. 3A, press configuration 300 illustrates a prior art hybrid flexographic and digital imager printing press used to produce variable indicia SOC secured documents that are well known in the industry with the modification of an additional second surface application sub system 306. The prior art portion of the press 300 unravels its paper web substrate from a roll 301 and flexographically prints 302 lower security layers in the scratch-off area as well as optionally prints the ticket's or document's display and the back non-variable information. At this point, the press web enters a secured imager room where the variable indicia are applied by monochromatic imager 303. However, as disclosed in recent alternate prior art embodiments, the imager employed could be a process color imager 303 (e.g., Memjet® Duralink) instead of the typical monochromatic imager. The process color imager 303, having the advantage of full color and the ability to print both the display and variable indicia with the disadvantage of higher cost.

The remainder of the prior art press configuration 300 includes a second, monochromatic, imager 304 utilized to print the variable information presented on the back of the ticket or document (e.g., inventory barcode) that is maintained in synchronization with the variable indicia imager 303. Subsequently, a series of flexographic print stations 305 print the upper security layers of a scratch-off document as well as any decorative overprint.

At this point, the present disclosure adds to the prior art press 306—shown in a magnified view in 306'. As illustrated in 306', a second surface material 307 (e.g., cold foil) is continuously fed past a digital imager 309 dispensing a specialty ink adhesive onto the back of the second surface material 307 with the digital imager 309 in synchronization with the front variable indicia imager 303. In an optional embodiment, as is known in the art, the applied specialty ink adhesive may be partially cured by a first set of UV lights 310. In an alternative embodiment, the specialty ink adhesive can be digitally imaged 312 onto the ticket or document printing web 308.

Regardless of where the specialty ink adhesive is applied or how it is cured, a nip roller 311 then places the second surface material 307 in direct contact with the ticket or document printing web 308 with the resulting composite web 315 subjected to a first or second curing process 314 to adhere the portions of the second surface material 307 in contact with the specialty ink adhesive to the ticket or document printing web 308 with the excess second surface material (i.e., not in direct contact with the specialty ink adhesive) removed from the web 316. At this point, the printed web would be processed with known prior art methods after first being rewound into a roll 317 for storage and ultimate processing by a separate packaging line.

Figure 3B:
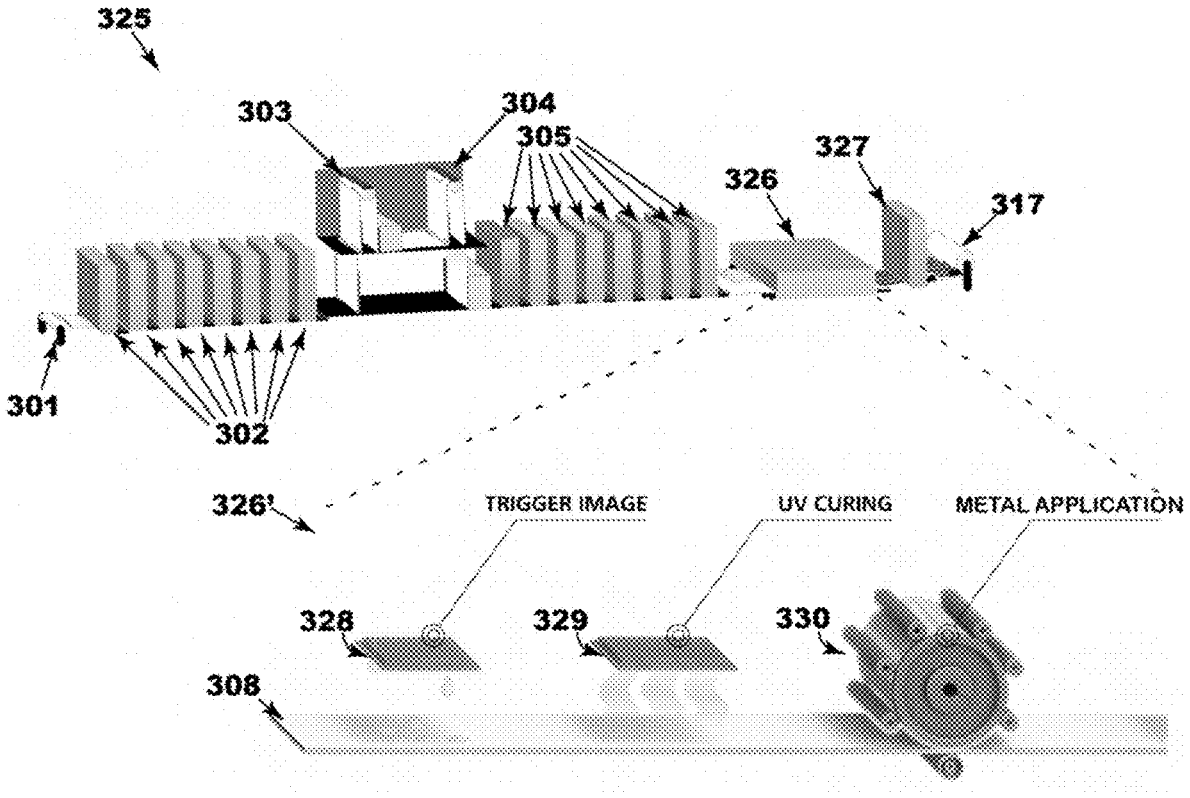
FIG. 3B is a schematic view of a first representative example of a digital press configuration capable of printing a second example embodiment of the modified scratch-off ticket or document of FIGS. 1C and 1D.

An alternative embodiment press configuration 325 capable of producing the specialty ink adhesive and metallic pigmented material such as the scratch-off ticket or document embodiments of FIGS. 1E and 2B is illustrated in FIG. 3B. As shown in FIG. 3B, press embodiment 325 illustrates the prior art hybrid flexographic and digital imager printing press used to produce variable indicia SOC secured documents with a modified second surface application sub system 326 as enabled by this disclosure. As before, the prior art press 325 unravels its paper web substrate from a roll 301 and flexographically prints 302 lower security layers in the scratch-off area as well as optionally prints the ticket's or document's display and the back non-variable information. At this point, the press web enters a secured imager room where the variable indicia are applied by a monochromatic and/or a process color imager 303 with variable data for the back of the ticket or document applied by another monochromatic and/or process color imager 304. Next, a series of flexographic print stations 305 print the upper security layers of the scratch-off ticket or document as well as any decorative overprint.

At this point, the present disclosure 326 adds to the prior art press 325—shown in a magnified view in 326'. As illustrated in 326', the printing substrate web 308 is continuously fed past a digital imager 328 (i.e., "Triggering Image") dispensing a specialty ink adhesive onto the web 308 with the digital imager 328 in synchronization with the front variable indicia imager 303. As is known in the art, the applied specialty ink adhesive will be partially cured (i.e., "UV Curing") by a first set of UV illumination lights 329. Afterward the metallic pigment (i.e., "Metal Application") is applied 330 via silicon coated donor rollers that carry the fine flakes of metal pigment from a reservoir to the web 308. Only those flakes that are in contact with the "Triggering Image" adhesive 328 are retained on the web 308, the remaining flakes returned to a reservoir for future applications. After the metallic pigment is applied, a secondary UV curing occurs 327 with the printed web finished using known prior art methods after first being rewound into a roll 317 for storage and ultimately processing by a separate packaging line.

Figure 3C:
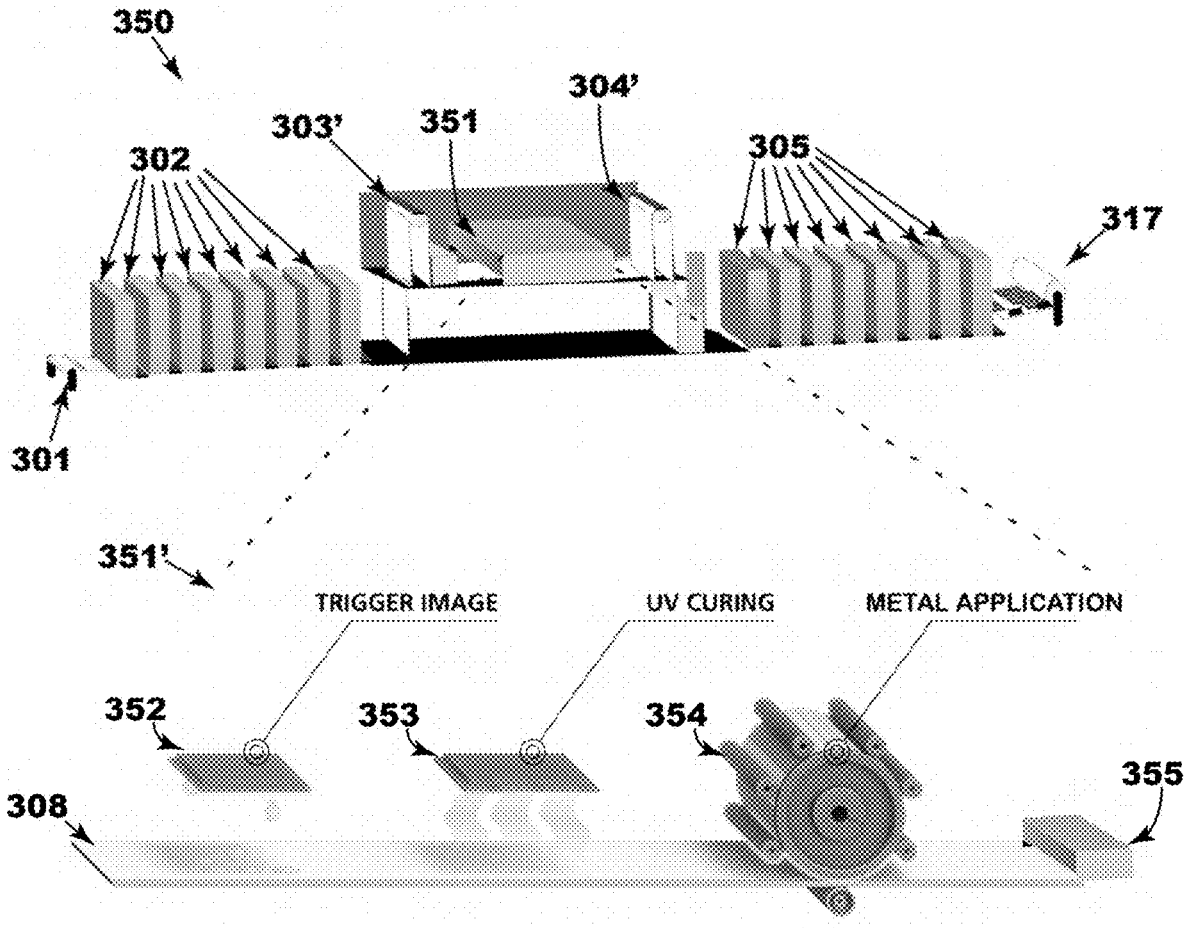
FIG. 3C is a schematic view of a representative example of a digital press configuration capable of printing the example embodiment of the modified scratch-off ticket or document of FIG. 1F.

Another alternative embodiment press configuration 350 is illustrated in FIG. 3C. This alternative embodiment 350 is capable of printing the specialty ink adhesive and metallic pigmented material as variable indicia as shown in the embodiments of FIGS. 1F and 2C. As before, press embodiment 350 (FIG. 3C) illustrates a prior art hybrid flexographic and digital imager printing press used to produce variable indicia SOC secured documents with a modified indicia imaging subsystem 351 enabled by this disclosure. The prior art portion of the press 350 unravels its paper web substrate from a roll 301 and flexographically prints 302 lower security layers in the scratch-off area as well as optionally prints the ticket's or document's display and the back non-variable information. However, as previously discussed, in some specific embodiments, the lower security layers will include additional countermeasures to protect the printed metallic appearing variable indicia from pick out attacks by including metal pigment (e.g., aluminum flakes) in at least one of the lower security layers.

At this point, the press web enters a secured imager room where the variable indicia are imaged with the metallic pigment and associated adhesive 351 (shown magnified in 351') as well as an optional prior art monochromatic and/or process color imager 303'. The variable data for the back of the ticket or document is subsequently applied by an additional monochromatic or process color imager 304'. As illustrated in 351', the printing substrate web 308 is continuously fed past a digital imager 352 (i.e., "Triggering Image") dispensing a specialty ink adhesive onto the web 308 with the digital imager 352 in synchronization with the front variable indicia imager 303' if optionally utilized. As is known in the art, the applied specialty ink adhesive is partially cured (i.e., "UV Curing") by a first set of UV illumination 353. Then the metallic pigment (i.e., "Metal Application") is applied 354 via silicon coated donor rollers carrying the fine flakes of metal pigment from a reservoir to the web 308. Only those flakes that are in contact with the "Triggering Image" adhesive 352 are retained on the web 308 with the remaining flakes return to a reservoir for future applications. After the metallic pigment is applied a secondary UV curing occurs 355 with the printed web subsequently processed with a series of flexographic print stations 305 printing the upper security layers of the scratch-off document as well as any decorative overprint. In a specific embodiment, like the lower security layers at least one of the upper security layers will include an additional countermeasure to protect the printed metallic appearing variable indicia from pick out attacks by including metal pigment (e.g., aluminum flakes). The metallic or foil overprint embodiments (e.g., FIGS. 1E and 2B) can also be added to the metallic appearing variable indicia ticket or document with the added benefit of higher security due to the homogeneous (relative to the metallic variable indicia) overprint. Finally, the ticket or document is finished with known prior art methods after first being rewound into a roll 317 for storage and ultimately processing by a separate packaging line.

Figure 4A:
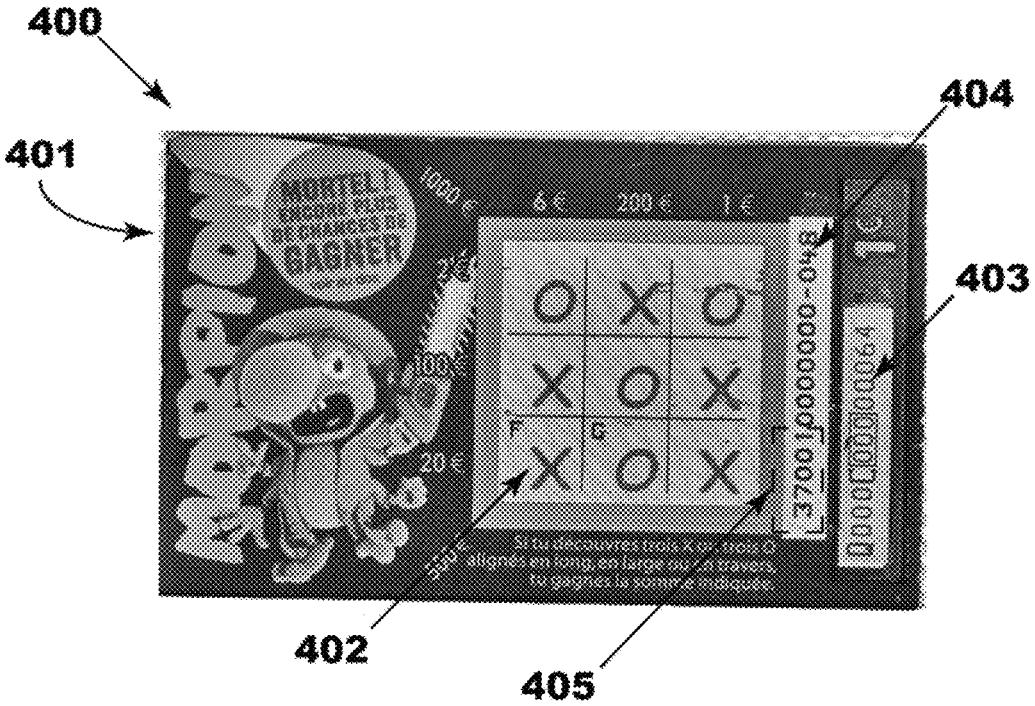
FIG. 4A is an exemplary view of white light illuminating an exemplary lottery-type instant ticket with embedded anti-copy countermeasures.
Figure 4B:
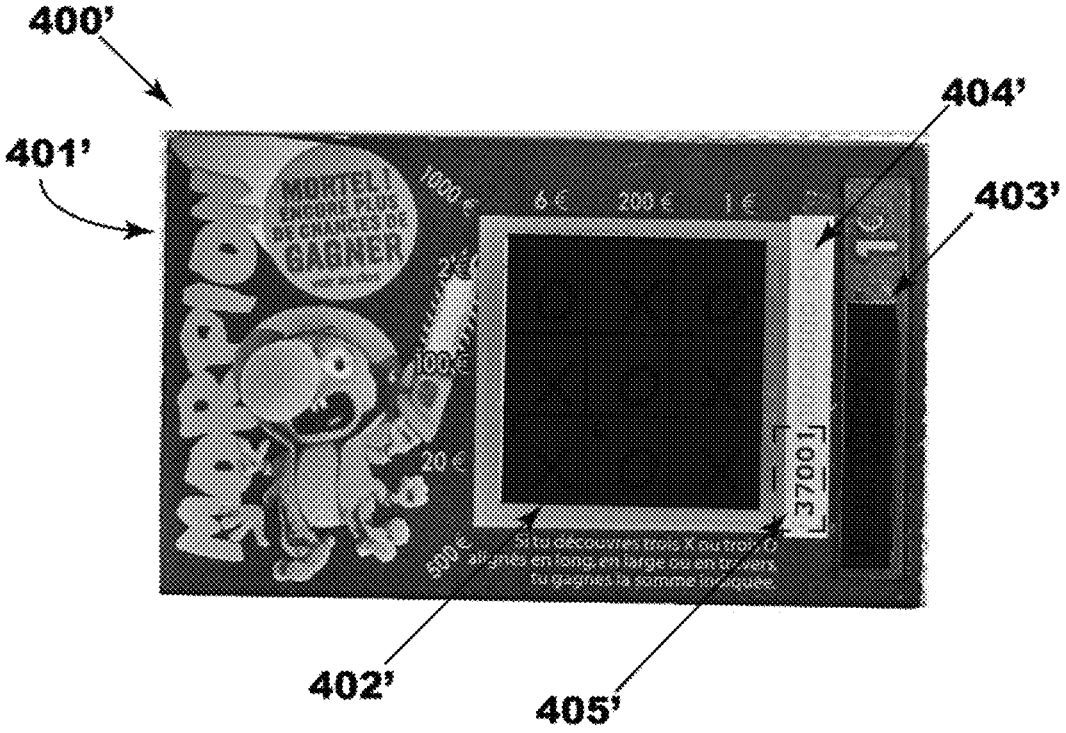
FIG. 4B is an exemplary view of infrared (IR) light illuminating the exemplary lottery-type instant ticket of FIG. 4A.

This is not to imply that only adhesives and foil or metal pigment applied to a ticket or document qualify as specialty inks. In other embodiments, specialty security inks can be applied as a portion of the variable indicia. FIGS. 4A and 4B taken together, provide a detailed specific embodiment of imaging the variable indicia on a ticket or document with both dye and pigmented based inks for enhanced security. FIG. 4A illustrates a ticket or document 400 with all of its scratch-off material removed illuminated in white light. Portions of the exposed variable indicia 402, 403, and 404 of FIG. 4A were imaged with dye based ink with the remaining portion 405 imaged with pigmented based ink. FIG. 4B illustrates 400' the same ticket or document 400 of FIG. 4A illuminated in infrared light.

In the detailed specific embodiment 400 of FIG. 4A, the ticket or document 400 is illustrated with all of its scratch-off material removed (so that the variable indicia 402 thru 405 are apparent), illuminated in white light. Variable indicia 402 and 403 were previously hidden under a SOC and variable indicia 404 and 405 were printed with no SOC covering, such that the variable indicia 404 and 405 were visible to the retailer and consumer before the ticket or document was purchased. The variable indicia that were previously hidden under SOC are higher security because they reveal to the consumer if the ticket is a winner 402 and provide validation information 403 for the retailer. The variable indicia 404 and 405 that were printed with no SOC covering provide inventory control information.

The vast majority of prior art tickets or documents are manufactured with dye based ink as the preferred medium for digitally imaging variable indicia. This is principally due to legacy reasons, since the industry standard for decades for printing variable indicia has been monochromatic Kodak ink jet imagers printing at a resolution of 240 dpi that have traditionally been dye based. Additionally, the various security tests for attempting to discern variable indicia on unscratched tickets or documents that have evolved over decades, for the most part assume that the variable indicia is printed with dye based ink and the industry is somewhat reluctant to abandon the predictability of a known medium for the somewhat unknown properties of pigmented based inks. However, recently advances in ink and imaging technologies have made printing instant ticket or documents with pigmented inks possible and even desirable in some cases. Nonetheless, for legacy reasons the industry may still be reluctant to image all variable indicia with pigmented ink until some experience with the ink and process is established. Additionally, some prior art instant ticket security validation systems automatically scan each ticket with both white and InfraRed (IR) illumination monitoring the two different illuminations for fading of the dye based variable indicia under the IR exposure, which is typical of dye based inks.

Thus, in the exemplary detailed specific embodiment 400 of FIG. 4A, only a portion 405 of the inventory control number is imaged with pigmented ink with the remaining portion 404 imaged with dye based ink. As previously discussed, the inventory control number (404 and 405) is visible on unscratched tickets or documents as opposed to the SOC covered variable indicia that reveal to the consumer if the ticket is a winner 402 and provide validation information 403 primarily for the retailer.

FIG. 4B illustrates 400' the same ticket or document 400 of FIG. 4A illuminated in IR light—i.e., ≈900 nm wavelength. As is known in the prior art, the lower opacity layer(s) of a scratch-off ticket or document found in the secure scratch-off regions tend to make the background contrast very low under IR illumination which would make it difficult to discern variable indicia printed in those secure areas—e.g., 402' and 403'. Conversely, the contrast of the inventory control number (404' and 405') area did not substantially change, this is because there are no lower opacity layer(s) printed under the inventory control number since the area required no additional security and was visible when the ticket or document was in virgin (i.e., pristine) condition.

Since the inventory control number (404' and 405') background contrast remains high under IR illumination, inherent features of dye and pigmented based inks can be further exploited over the prior art as security countermeasures for counterfeit (e.g., photocopied) detection. Specifically, in the exemplary detailed specific embodiment 400' of FIG. 4B, one portion of the inventory control number 404' was printed with a dye based ink with the remaining portion 405' printed with a pigmented ink—i.e., the dye based portion 404' fades almost completely into the background because there is virtually no reflectivity of IR wavelength light inherent in its dye based chemistry, while the pigmented based portion 405' persists with virtually the same contrast to the background as under white light illumination. Though, if the same type of IR illumination were applied to a photocopied forgery a similar portion fade of the inventory control number portion that was imaged with dye based ink 404' would not be realized, because the photocopy would include the same type of ink for both portions of the inventory control number. When it is realized that the difference between pigmented and dye based inks are difficult to ascertain in white light illumination without study, it can be appreciated that the dual imaging of the variable indicia with both dye and pigmented based inks can be employed as an effective countermeasure. Other portions of a ticket or document (e.g., variable data on the ticket back, secure variable indicia on an IR high contrast background) can be partially imaged with both dye and pigmented ink with the same and possibly enhanced security features.

Figure 5:
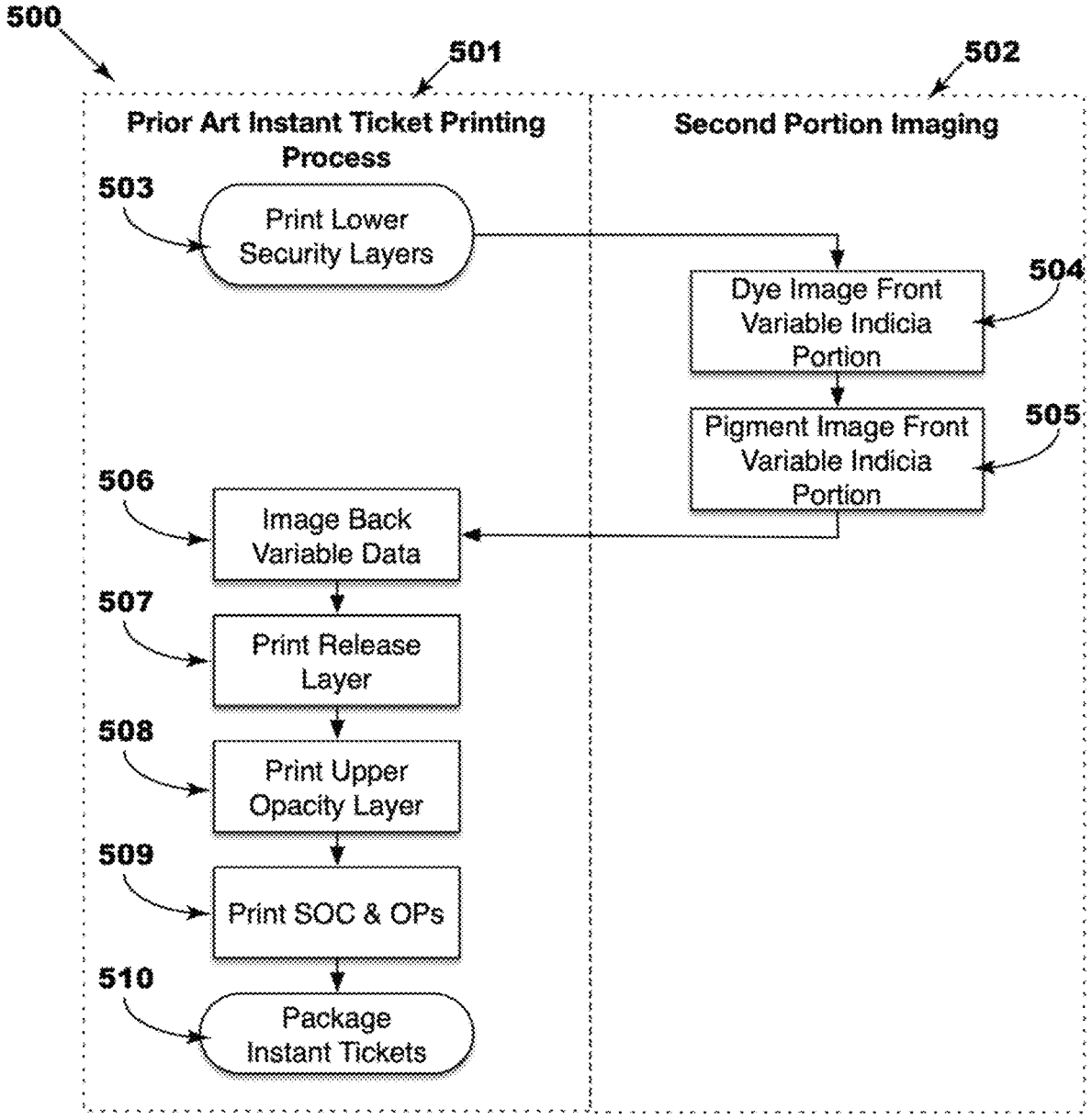
FIG. 5 is a swim lane flowchart providing a schematic graphical overview for applying both pigmented and dye based indicia that is compatible with the exemplary lottery-type instant ticket of FIGS. 4A and 4B.

FIG. 5 illustrates the previously disclosed exemplary detailed specific embodiment 400 and 400' of FIGS. 4A and 4B as a swim lane flow chart 500. As illustrated in the swim lane flowchart 500, the embodiment of the disclosure is conceptually divided into two groups (i.e., "Prior Art Instant Ticket Printing Process" 501 and "Second Portion Imaging" 502) by the two "swim lane" columns as shown in FIG. 5. As before, if a particular flowchart function appears completely within a swim lane, its functionality is limited to the data category of the associated swim lane. Again, as its name implies, the Prior Art Instant Ticket Printing Process swim lane column 501 illustrates the functional steps or components that are already known in the art with the Second Portion Imaging swim lane column 502 highlighting the innovation of this disclosure.

The FIG. 5 swim lane flowchart 500 begins with the web substrate printed 503 with the lower security layers to provide opacity and chemical barriers in the general area where the variable indicia will be imaged. The swim lane flowchart 500 then departs from prior art traditional fabrication 501 to Second Portion Imaging 502 with variable indicia partially imaged 504 on top of the lower security layers and optionally other areas on the front of the ticket or document with a dye based ink. After the partial printing of the front variable indicia with a dye based imager is complete 504, the web substrate is advanced to a second synchronized pigment based imager where the remaining portion of the front variable indicia are imaged 505. At this point, swim lane flowchart 500 returns to the Prior Art Instant Ticket Printing Process swim lane column 501 to complete production.

Next, variable data or indicia printed on the back of the ticket is imaged 506—also printed in synchronization with the dye and pigment based front imagers. Then the release layer(s) is/are printed 507 using a fixed plate printing process to cover the general area of the variable indicia. After the release layer(s) is/are applied 507, at least one upper opacity layer is printed 508 followed by the SOC 509 and any Overprints (OPs) are applied with a fixed plate printing process over the release layer(s). Finally, the printed ticket or document is forwarded to packaging 510 for finishing.

Figure 6:
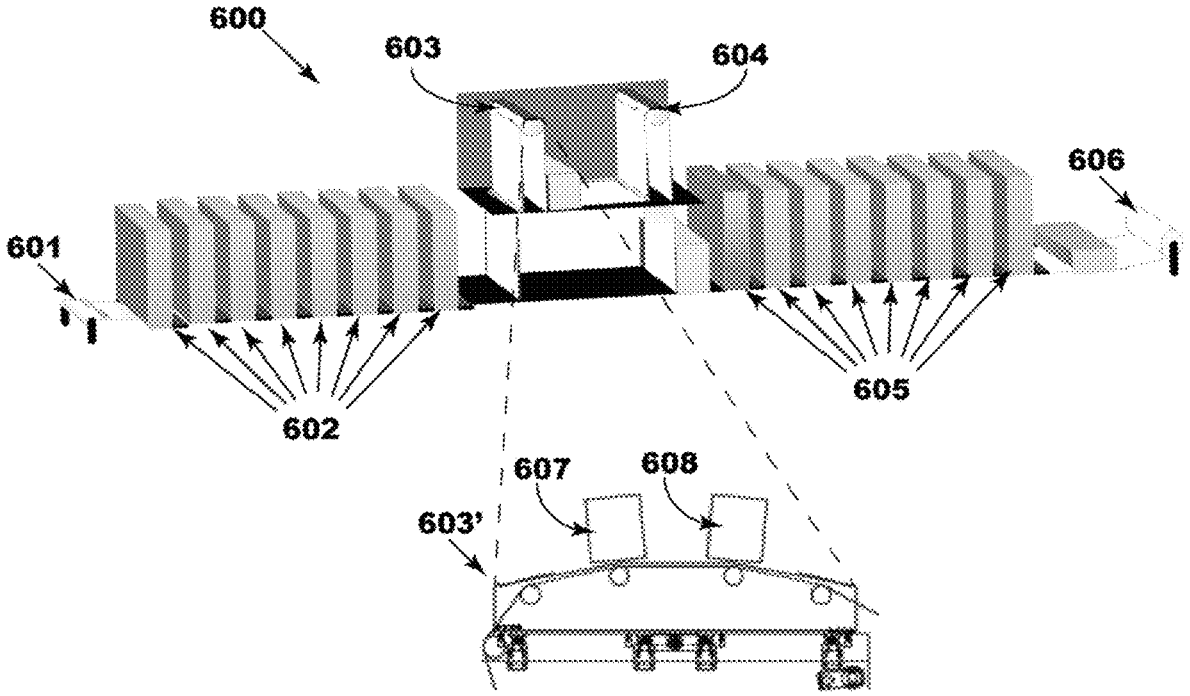
FIG. 6 is a schematic view of a first representative example of a digital press configuration capable of printing the example modified lottery-type instant ticket of FIGS. 4A and 4B.

One possible press configuration 600 capable of producing the ticket or document embodiment of FIGS. 4A and 4B is illustrated in FIG. 6. As shown in FIG. 6, press configuration 600 illustrates a modified hybrid flexographic and digital imager printing press used to produce variable indicia SOC secured documents that is typical in the industry. The modified prior art press configuration 600 unravels its paper web substrate from a roll 601 and flexographically prints 602 lower security layers in the scratch-off area as well as optionally prints the ticket's or document's display and the back non-variable information. At this point, the press web enters a secured imager room where the front variable indicia are applied by imager 603. However, as disclosed herein with magnified view 603', the front variable indicia are imaged as two different portions with the standard dye based portion printed by a first imager head 607 and the remaining pigmented based portion imaged by a second imager head 608.

The remainder of the prior art press configuration 600 is typical of the industry standard including a second, imager 604 utilized to print the variable information presented on the back of the ticket or document with subsequent series of flexographic print stations 605 printing the upper security layers as well as any decorative overprint. At this point, the web would be rewound into a roll 606 for storage and ultimate processing by a separate packaging line.

There are other variations of the disclosed embodiments that would be apparent to anyone skilled in the art in view of the present disclosure and would be within the parameters of the appended claims.

What is claimed is:

1. A method for producing a security layered scratch-off protected document with variable indicia wherein a first portion of the variable indicia is formed with a pigmented based ink and a different second portion of the variable indicia is formed with a dye based ink, the method comprising:

printing, with first fixed plates, lower security layers comprising a lower opacity layer printed over a substrate and a higher contrast background layer;

printing, with a first digital imager, the first portion of the variable indicia with the pigmented based ink;

printing, with a second digital imager, the second portion of the variable indicia with the dye based ink; and printing, with second fixed plates, an upper security stack over at least some of the variable indicia, the upper security stack comprising a water based transparent or translucent seal coat, a direct energy cured transparent or translucent release coat, and a Scratch-Off Coating (SOC).

2. The method of claim 1, wherein the upper security stack comprises a water based opacity layer.

3. The method of claim 1, which comprises printing the first portion of the variable indicia on top of the lower security layers.

4. The method of claim 1, which comprises printing the second portion of the variable indica on top of the lower security layers.

5. The method of claim 1, which comprises printing the first portion of the variable indicia on an area of the substrate other than on the lower security layers.

6. The method of claim 1, which comprises printing the second portion of the variable indicia on an area of the substrate other than the lower security layers.

* * * * *